US007871336B2

(12) United States Patent
Breier et al.

(10) Patent No.: US 7,871,336 B2
(45) **Date of Patent: *Jan. 18, 2011**

(54) GOLF CLUB HAVING REMOVABLE SOLE WEIGHT USING CUSTOM AND INTERCHANGEABLE PANELS

(75) Inventors: Joshua G. Breier, Carlsbad, CA (US); Karl A. Clausen, Carlsbad, CA (US); Douglas E. Roberts, Carlsbad, CA (US); Peter L. Soracco, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/412,410

(22) Filed: Mar. 27, 2009

(65) Prior Publication Data

US 2009/0221381 A1 Sep. 3, 2009

Related U.S. Application Data

(63) Continuation of application No. 12/408,894, filed on Mar. 23, 2009, which is a continuation-in-part of application No. 12/263,532, filed on Nov. 3, 2008, and a continuation-in-part of application No. 11/563,224, filed on Nov. 27, 2006, now Pat. No. 7,621,820.

(51) Int. Cl.

| | |
|---|---|
| ***A63B 53/02*** | (2006.01) |
| ***A63B 53/04*** | (2006.01) |
| ***A63B 53/06*** | (2006.01) |
| ***A63B 53/16*** | (2006.01) |

(52) U.S. Cl. ..... 473/244; 473/305; 473/304; 473/311; 473/314; 473/332; 473/245; 473/246; 473/288; 473/334; 473/344; 473/345

(58) Field of Classification Search ..... 473/305–315, 473/244–248, 328, 344, 287–292, 334–339, 473/345, 349

See application file for complete search history.

(56) References Cited

U.S. PATENT DOCUMENTS

| | | | | | |
|---|---|---|---|---|---|
| 1,249,127 | A | * | 12/1917 | Lard | 473/309 |
| 1,313,504 | A | * | 8/1919 | Rolfe | 473/246 |
| 1,535,707 | A | * | 4/1925 | Barnes | 473/248 |
| 1,559,299 | A | * | 10/1925 | Barach | 473/306 |

(Continued)

OTHER PUBLICATIONS

Callaway Golf, "Optimize Your Driver," www.callawaygolf.com/de.cg.Features.Optifit.html.

(Continued)

*Primary Examiner*—Sebastiano Passaniti
(74) *Attorney, Agent, or Firm*—Randy K. Chang

(57) ABSTRACT

A golf club head is presented comprising a sole including a removable panel secured to the sole via a non-threaded attachment assembly. Further, the removable panel may have a large surface area relative to its thickness, resulting in a chip-like or wafer-like weight member. This design allows the mass of the removable panel to be spread substantially along the surface of the sole as opposed to in the interior of the club head. The golf club head may comprise more than one removable panel. A removable panel of the present invention may generally comprise one or more discrete areas of higher basis weight or higher density. Even further, the removable panel may generally be releasably attached via a quick disconnect mechanism that allows easy interchangeability.

16 Claims, 34 Drawing Sheets

U.S. PATENT DOCUMENTS

| | | | | | |
|---|---|---|---|---|---|
| 1,703,581 | A | * | 2/1929 | Gavin | 473/246 |
| 1,765,982 | A | * | 6/1930 | Keating | 473/248 |
| 2,020,679 | A | | 12/1935 | Fitzpatrick | |
| 2,067,556 | A | * | 1/1937 | Wettlaufer | 473/308 |
| 2,100,864 | A | * | 11/1937 | Mansur | 473/309 |
| 2,328,583 | A | * | 9/1943 | Reach | 473/338 |
| 2,332,342 | A | * | 10/1943 | Reach | 473/248 |
| D137,283 | S | * | 2/1944 | Jakosky | D21/734 |
| D139,462 | S | * | 11/1944 | Jakosky | D21/734 |
| 3,524,646 | A | | 8/1970 | Wheeler | |
| 3,572,709 | A | * | 3/1971 | Risher | 473/308 |
| 3,819,181 | A | * | 6/1974 | Mills | 473/306 |
| 4,078,722 | A | | 3/1978 | Luckenbill | |
| 4,150,464 | A | | 4/1979 | Tracy | |
| 4,712,575 | A | | 12/1987 | Lair et al. | |
| 5,039,098 | A | | 8/1991 | Pelz | |
| 5,042,806 | A | * | 8/1991 | Helmstetter | 473/311 |
| 5,116,047 | A | * | 5/1992 | Phelan et al. | 473/307 |
| 5,228,470 | A | | 7/1993 | Lair et al. | |
| 5,433,442 | A | | 7/1995 | Walker | |
| 5,435,551 | A | * | 7/1995 | Chen | 473/342 |
| 5,509,660 | A | * | 4/1996 | Elmer | 473/288 |
| 5,720,674 | A | | 2/1998 | Galy | |
| 5,794,316 | A | | 8/1998 | Anscher | |
| 5,807,186 | A | * | 9/1998 | Chen | 473/248 |
| 5,924,938 | A | * | 7/1999 | Hines | 473/307 |
| 5,951,411 | A | | 9/1999 | Wood et al. | |
| 6,033,318 | A | * | 3/2000 | Drajan et al. | 473/309 |
| 6,458,044 | B1 | | 10/2002 | Vincent et al. | |
| 6,547,673 | B2 | | 4/2003 | Roark | |
| 6,569,029 | B1 | * | 5/2003 | Hamburger | 473/238 |
| 6,620,053 | B2 | | 9/2003 | Tseng | |
| 6,648,772 | B2 | | 11/2003 | Vincent et al. | |
| 6,668,428 | B2 | | 12/2003 | Moeller | |
| 6,773,360 | B2 | | 8/2004 | Willett et al. | |
| 6,860,818 | B2 | | 3/2005 | Mahaffey et al. | |
| 6,902,432 | B2 | | 6/2005 | Morikawa et al. | |
| 6,981,922 | B2 | | 1/2006 | Lenhof et al. | |
| 7,083,529 | B2 | | 8/2006 | Cackett et al. | |
| 7,163,465 | B2 | | 1/2007 | Edel | |
| 7,186,190 | B1 | | 3/2007 | Beach et al. | |
| 7,419,441 | B2 | | 9/2008 | Hoffman et al. | |
| 2006/0122004 | A1 | | 6/2006 | Chen et al. | |
| 2007/0105646 | A1 | | 5/2007 | Beach et al. | |
| 2008/0254909 | A1 | * | 10/2008 | Callinan et al. | 473/307 |
| 2010/0041490 | A1 | * | 2/2010 | Boyd et al. | 473/288 |

OTHER PUBLICATIONS

Nakashima Golf, "HTec Titanium Driver," www.nakashimagolf.com/drivers_htec.htm.

Cash Acme, "SharkBite Water Heater Installation Kits," www.cashacme.com/sharkbitewaterheater.html.

Tgw.com, "TaylorMade TLC Club Weights/Accessories," www.tgw.com/customer/category/product.jsp?SUBCATEGORY_IC=5898.

Brent Kelley, About.com, "Equipment Update- KZG GF 4 Driver, Dunlop Balls, Callaway Optifit," golf.about.com/od/equipmentreviews/a/equip030906a.htm.

* cited by examiner

M(g)

| | 0.5 | 1.5 | 2.5 | 3.5 | 4.5 | 5.5 | 6.5 | 7.5 | 8.5 | 9.5 | 10.5 | 11.5 | 12.5 | 13.5 | 14.5 | 15.5 | 16.5 | 17.5 | 18.5 | 19.5 | 20.5 | 21.5 | 22.5 | 23.5 | 24.5 | 25.5 | 26.5 | 27.5 |
|---|---|---|---|---|---|---|---|---|---|---|---|---|---|---|---|---|---|---|---|---|---|---|---|---|---|---|---|---|
| 29.5 | | | | | | | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | | |
| 28.5 | | | | | | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | |
| 27.5 | | | | | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | |
| 26.5 | | | | | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 |
| 25.5 | | | | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 |
| 24.5 | | | | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 |
| 23.5 | | | | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 |
| 22.5 | | | | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 |
| 21.5 | | | | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 |
| 20.5 | | | | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 |
| 19.5 | | | | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 |
| 18.5 | | | | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 |
| 17.5 | | | | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | |
| 16.5 | | | | | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | |
| 15.5 | | | | | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | |
| 14.5 | | | | | | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | | |
| 13.5 | | | | | | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | | | |
| 12.5 | | | | | | | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | | | | |
| 11.5 | | | | | | | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | | | | | |
| 10.5 | | | | | | | | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | | | | | | |
| 9.5 | | | | | | | | | 0.10438 | 0.10438 | 0.10438 | 0.10438 | 0.10438 | 0.10438 | 0.10438 | 0.10438 | 0.10438 | 0.10438 | 0.10438 | 0.10438 | 0.10438 | | | | | | | |
| 8.5 | | | | | | | | | | | 0.10438 | 0.10438 | 0.10438 | 0.10438 | 0.10438 | 0.10438 | 0.10438 | 0.10438 | 0.10438 | 0.10438 | | | | | | | | |
| 7.5 | | | | | | | | | | | | | 0.10438 | 0.10438 | 0.10438 | 0.10438 | 0.10438 | 0.10438 | | | | | | | | | | |

FIG. 10

M(g)

| | 0.5 | 1.5 | 2.5 | 3.5 | 4.5 | 5.5 | 6.5 | 7.5 | 8.5 | 9.5 | 10.5 | 11.5 | 12.5 | 13.5 | 14.5 | 15.5 | 16.5 | 17.5 | 18.5 | 19.5 | 20.5 | 21.5 | 22.5 | 23.5 | 24.5 | 25.5 | 26.5 | 27.5 | 28.5 |
|---|---|---|---|---|---|---|---|---|---|---|---|---|---|---|---|---|---|---|---|---|---|---|---|---|---|---|---|---|---|
| 29.5 | | | | | | | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | | | |
| 28.5 | | | | | | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | | |
| 27.5 | | | | | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | | |
| 26.5 | | | | | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | |
| 25.5 | | | | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | |
| 24.5 | | | | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | |
| 23.5 | | | | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | |
| 22.5 | | | | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | |
| 21.5 | | | | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | |
| 20.5 | | | | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | |
| 19.5 | | | | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | |
| 18.5 | | | | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | |
| 17.5 | | | | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | | |
| 16.5 | | | | | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | | |
| 15.5 | | | | | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | | |
| 14.5 | | | | | | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | | | |
| 13.5 | | | | | | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | | | | |
| 12.5 | | | | | | | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | | | | | |
| 11.5 | | | | | | | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | | | | | | |
| 10.5 | | | | | | | | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | 0.095745 | | | | | 1030.405 | | |
| 9.5 | | | | | | | | | 0.095745 | 0.095745 | 0.095745 | 0.095745 | 0.555556 | 0.555556 | 0.555556 | 0.555556 | 0.555556 | 0.095745 | 0.095745 | 0.095745 | 0.095745 | | | | | | 1079.476 | | |
| 8.5 | | | | | | | | | | | 0.095745 | 0.095745 | 0.095745 | 0.555556 | 0.555556 | 0.555556 | 0.095745 | 0.095745 | 0.095745 | 0.095745 | | | | | | | 54.09951 | | |
| 7.5 | | | | | | | | | | | | | 0.095745 | 0.095745 | 0.555556 | 0.095745 | 0.095745 | 0.095745 | | | | | | | | | | | |

FIG. 11

M(g)

| | 0.5 | 1.5 | 2.5 | 3.5 | 4.5 | 5.5 | 6.5 | 7.5 | 8.5 | 9.5 | 10.5 | 11.5 | 12.5 | 13.5 | 14.5 | 15.5 | 16.5 | 17.5 | 18.5 | 19.5 | 20.5 | 21.5 | 22.5 | 23.5 | 24.5 | 25.5 | 26.5 | 27.5 | 28.5 |
|---|---|---|---|---|---|---|---|---|---|---|---|---|---|---|---|---|---|---|---|---|---|---|---|---|---|---|---|---|---|
| 29.5 | | | | | | | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | | | |
| 28.5 | | | | | | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | | |
| 27.5 | | | | | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | | |
| 26.5 | | | | | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | |
| 25.5 | | | | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | |
| 24.5 | | | | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | |
| 23.5 | | | | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | |
| 22.5 | | | | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | |
| 21.5 | | | | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | |
| 20.5 | | | | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | |
| 19.5 | | | | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | |
| 18.5 | | | | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | |
| 17.5 | | | | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | | |
| 16.5 | | | | | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | | |
| 15.5 | | | | | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | | |
| 14.5 | | | | | | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | | | |
| 13.5 | | | | | | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | | | | |
| 12.5 | | | | | | | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | | | | | |
| 11.5 | | | | | | | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | 0.09636 | | | | | | |
| 10.5 | | | | | | | | 0.09636 | 0.09636 | 0.09636 | 0.09636 | 0.09636 | 0.09636 | 0.09636 | 0.41667 | 0.41667 | 0.09636 | 0.09636 | 0.09636 | 0.09636 | 0.09636 | 0.09636 | | | | | 841.52 | | |
| 9.5 | | | | | | | | | 0.09636 | 0.09636 | 0.09636 | 0.09636 | 0.09636 | 0.09636 | 0.41667 | 0.41667 | 0.09636 | 0.09636 | 0.09636 | 0.09636 | 0.09636 | | | | | | 946.35 | | |
| 8.5 | | | | | | | | | | | 0.09636 | 0.09636 | 0.09636 | 0.41667 | 0.41667 | 0.41667 | 0.41667 | 0.09636 | 0.09636 | 0.09636 | | | | | | | 49.66 | | |
| 7.5 | | | | | | | | | | | | | 0.09636 | 0.41667 | 0.41667 | 0.41667 | 0.41667 | 0.09636 | | | | | | | | | | | |

FIG. 12

M(g)

| | 0.5 | 1.5 | 2.5 | 3.5 | 4.5 | 5.5 | 6.5 | 7.5 | 8.5 | 9.5 | 10.5 | 11.5 | 12.5 | 13.5 | 14.5 | 15.5 | 16.5 | 17.5 | 18.5 | 19.5 | 20.5 | 21.5 | 22.5 | 23.5 | 24.5 | 25.5 | 26.5 | 27.5 | 28.5 |
|---|---|---|---|---|---|---|---|---|---|---|---|---|---|---|---|---|---|---|---|---|---|---|---|---|---|---|---|---|---|
| 29.5 | | | | | | | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | | | |
| 28.5 | | | | | | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | | |
| 27.5 | | | | | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | | |
| 26.5 | | | | | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | |
| 25.5 | | | | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | |
| 24.5 | | | | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | |
| 23.5 | | | | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | |
| 22.5 | | | | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | |
| 21.5 | | | | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | |
| 20.5 | | | | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | |
| 19.5 | | | | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | |
| 18.5 | | | | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | |
| 17.5 | | | | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | | |
| 16.5 | | | | | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | | |
| 15.5 | | | | | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | | |
| 14.5 | | | | | | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | | | |
| 13.5 | | | | | | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | | | | |
| 12.5 | | | | | | | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | | | | | |
| 11.5 | | | | | | | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | | | | | | |
| 10.5 | | | | | | | | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | 0.09698 | | | | | | | |
| 9.5 | | | | | | | | | 0.09698 | 0.09698 | 0.09698 | 0.09698 | 0.09698 | 0.33333 | 0.33333 | 0.33333 | 0.33333 | 0.33333 | 0.09698 | 0.09698 | 0.09698 | | | | 865.76 | | | | |
| 8.5 | | | | | | | | | | | 0.09698 | 0.09698 | 0.09698 | 0.33333 | 0.33333 | 0.33333 | 0.33333 | 0.33333 | 0.09698 | 0.09698 | | | | | 32.07 | | | | |
| 7.5 | | | | | | | | | | | | | 0.09698 | 0.33333 | 0.33333 | 0.33333 | 0.33333 | 0.33333 | | | | | | | | | | | |

FIG. 13

M(g)

| | 0.5 | 1.5 | 2.5 | 3.5 | 4.5 | 5.5 | 6.5 | 7.5 | 8.5 | 9.5 | 10.5 | 11.5 | 12.5 | 13.5 | 14.5 | 15.5 | 16.5 | 17.5 | 18.5 | 19.5 | 20.5 | 21.5 | 22.5 | 23.5 | 24.5 | 25.5 | 26.5 | 27.5 | 28.5 |
|---|---|---|---|---|---|---|---|---|---|---|---|---|---|---|---|---|---|---|---|---|---|---|---|---|---|---|---|---|---|
| 29.5 | | | | | | | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | | | |
| 28.5 | | | | | | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | | |
| 27.5 | | | | | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | | |
| 26.5 | | | | | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | |
| 25.5 | | | | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | |
| 24.5 | | | | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | |
| 23.5 | | | | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | |
| 22.5 | | | | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | |
| 21.5 | | | | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | |
| 20.5 | | | | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | |
| 19.5 | | | | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | |
| 18.5 | | | | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | |
| 17.5 | | | | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | | |
| 16.5 | | | | | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | | |
| 15.5 | | | | | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | | |
| 14.5 | | | | | | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | | | |
| 13.5 | | | | | | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | | | | |
| 12.5 | | | | | | | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | | | | | |
| 11.5 | | | | | | | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | | | | | | |
| 10.5 | | | | | | | | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | | | | | | | |
| 9.5 | | | | | | | | | 0.09719 | 0.09719 | 0.09719 | 0.09719 | 0.09719 | 0.31250 | 0.31250 | 0.31250 | 0.31250 | 0.09719 | 0.09719 | 0.09719 | 0.09719 | | | | 656.41 | | | | |
| 8.5 | | | | | | | | | | | 0.09719 | 0.09719 | 0.31250 | 0.31250 | 0.31250 | 0.31250 | 0.31250 | 0.31250 | 0.09719 | 0.09719 | | | | | 27.35 | | | | |
| 7.5 | | | | | | | | | | | | | 0.31250 | 0.31250 | 0.31250 | 0.31250 | 0.31250 | 0.31250 | | | | | | | | | | | |

FIG. 14

M(g)

| | 0.5 | 1.5 | 2.5 | 3.5 | 4.5 | 5.5 | 6.5 | 7.5 | 8.5 | 9.5 | 10.5 | 11.5 | 12.5 | 13.5 | 14.5 | 15.5 | 16.5 | 17.5 | 18.5 | 19.5 | 20.5 | 21.5 | 22.5 | 23.5 | 24.5 | 25.5 | 26.5 | 27.5 | 28.5 |
|---|---|---|---|---|---|---|---|---|---|---|---|---|---|---|---|---|---|---|---|---|---|---|---|---|---|---|---|---|---|
| 29.5 | | | | | | | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | | | |
| 28.5 | | | | | | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | | |
| 27.5 | | | | | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | | |
| 26.5 | | | | | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | |
| 25.5 | | | | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | |
| 24.5 | | | | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | |
| 23.5 | | | | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | |
| 22.5 | | | | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | |
| 21.5 | | | | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | |
| 20.5 | | | | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | |
| 19.5 | | | | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | |
| 18.5 | | | | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | |
| 17.5 | | | | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | 0.09719 | | |
| 16.5 | | | | | 0.09719 | 0.09719 | 0.09719 | 0.09719 | 0.09719 | 0.09719 | 0.09719 | 0.09719 | 0.09719 | 0.09719 | 0.31250 | 0.31250 | 0.09719 | 0.09719 | 0.09719 | 0.09719 | 0.09719 | 0.09719 | 0.09719 | 0.09719 | 0.09719 | 0.09719 | 0.09719 | | |
| 15.5 | | | | | 0.09719 | 0.09719 | 0.09719 | 0.09719 | 0.09719 | 0.09719 | 0.09719 | 0.09719 | 0.09719 | 0.09719 | 0.31250 | 0.31250 | 0.09719 | 0.09719 | 0.09719 | 0.09719 | 0.09719 | 0.09719 | 0.09719 | 0.09719 | 0.09719 | 0.09719 | 0.09719 | | |
| 14.5 | | | | | | 0.09719 | 0.09719 | 0.09719 | 0.09719 | 0.09719 | 0.09719 | 0.09719 | 0.09719 | 0.09719 | 0.31250 | 0.31250 | 0.09719 | 0.09719 | 0.09719 | 0.09719 | 0.09719 | 0.09719 | 0.09719 | 0.09719 | 0.09719 | | | | |
| 13.5 | | | | | | 0.09719 | 0.09719 | 0.09719 | 0.09719 | 0.09719 | 0.09719 | 0.09719 | 0.09719 | 0.09719 | 0.31250 | 0.31250 | 0.09719 | 0.09719 | 0.09719 | 0.09719 | 0.09719 | 0.09719 | 0.09719 | 0.09719 | | | | | |
| 12.5 | | | | | | | 0.09719 | 0.09719 | 0.09719 | 0.09719 | 0.09719 | 0.09719 | 0.09719 | 0.09719 | 0.31250 | 0.31250 | 0.09719 | 0.09719 | 0.09719 | 0.09719 | 0.09719 | 0.09719 | 0.09719 | 0.09719 | | | | | |
| 11.5 | | | | | | | 0.09719 | 0.09719 | 0.09719 | 0.09719 | 0.09719 | 0.09719 | 0.09719 | 0.09719 | 0.31250 | 0.31250 | 0.09719 | 0.09719 | 0.09719 | 0.09719 | 0.09719 | 0.09719 | 0.09719 | | | | | | |
| 10.5 | | | | | | | | 0.09719 | 0.09719 | 0.09719 | 0.09719 | 0.09719 | 0.09719 | 0.09719 | 0.31250 | 0.31250 | 0.09719 | 0.09719 | 0.09719 | 0.09719 | 0.09719 | 0.09719 | | | | | | | |
| 9.5 | | | | | | | | | 0.09719 | 0.09719 | 0.09719 | 0.09719 | 0.09719 | 0.09719 | 0.31250 | 0.31250 | 0.09719 | 0.09719 | 0.09719 | 0.09719 | 0.09719 | | | | | | | | |
| 8.5 | | | | | | | | | | | 0.09719 | 0.09719 | 0.09719 | 0.09719 | 0.09719 | 0.09719 | 0.09719 | 0.09719 | 0.09719 | 0.09719 | | | | | | | | | |
| 7.5 | | | | | | | | | | | | | 0.09719 | 0.09719 | 0.09719 | 0.09719 | 0.09719 | 0.09719 | | | | | | | | | | | |

FIG. 15

GOLF CLUB HAVING REMOVABLE SOLE WEIGHT USING CUSTOM AND INTERCHANGEABLE PANELS

CROSS-REFERENCE TO RELATED APPLICATION

The present application is a Continuation of U.S. application Ser. No. 12/408,894 filed Mar. 23, 2009; which is a Continuation-In-Part of both co-pending U.S. application Ser. No. 12/263,532, filed Nov. 3, 2008 and U.S. application Ser. No. 11/563,224, filed Nov. 27, 2006 now U.S. Pat. No. 7,621,820; the disclosures of which are hereby incorporated by reference in their entirety.

FIELD OF THE INVENTION

The invention relates to golf clubs, and more particularly, to metal wood and utility-type golf clubs having dynamic mass properties. Even more particularly, to metal wood and utility type clubs having a customizable and interchangeable panel attached to the body of the golf club head wherein the customizable and interchangeable panel helps improve the aesthetic and performance characteristics of the golf club.

BACKGROUND OF THE INVENTION

Wood and utility-type golf club heads generally include a front or striking face, a crown, a sole, and an arcuate skirt including a heel, a toe, and a back. The striking face interfaces with and contacts the golf ball. A plurality of grooves, sometimes referred to as "score lines," may be provided on the face to assist in imparting spin to the ball and for decorative purposes. The crown is generally configured to have a particular look to the golfer and to provide structural rigidity for the striking face. The sole of the golf club contacts and interacts with the ground during the swing.

With a high percentage of amateur golfers constantly searching for more distance on their shots, particularly their drives, the golf industry has responded by providing golf clubs specifically designed with distance and accuracy in mind. The head sizes of wood-type golf clubs have increased, allowing the club to possess a higher moment of inertia (MOI), which translates to a greater ability to resist twisting on off-center hits. Generally, as a wood-type club head becomes larger, its center of gravity will be moved back away from the face and further toward the toe, resulting in hits flying higher and further to the right than expected (for right-handed golfers). Reducing the lofts of the larger head clubs can compensate for this. Because the center of gravity is moved further away from hosel axis, the larger heads can also cause these clubs to remain open on contact, thereby inducing a "slice" effect (in the case of a right-handed golfer the ball deviates to the right). Offsetting the head and/or incorporating a hook face angle can help compensate for this by "squaring" the face at impact, but often more is required to eliminate the "slice" tendency.

Another technological breakthrough in recent years to provide the average golfer with more distance is to make larger head clubs while keeping the weight constant or even lighter by casting consistently thinner shell thicknesses and using lighter materials such as titanium, magnesium, and composites. Also, the faces of the clubs have been steadily becoming thinner, because a thinner face will maximize what is known as the coefficient of restitution (COR) from impacts with golf balls. The more a face rebounds upon impact, the more energy is imparted to the ball, thereby increasing the resulting distance that the ball travels.

Known methods to enhance the weight distribution of wood-type club heads to help reduce the club from being open upon contact with the ball usually include the addition of weights to the body casting itself or strategically adding a weight element at some point in the club. Efforts to incorporate weight elements into the wood-type club head are discussed in the patent literature. For instance, U.S. Pat. No. 7,186,190 discloses a golf club head comprising a number of moveable weights attached to the body of the club head. The club head of the '190 includes a number of threaded ports into which the moveable weights are screwed. Though the mass characteristics of the golf club may be manipulated by rearranging the moveable weights, the cylindrical shape of the weights and their placement within the golf club body necessarily moves a significant portion of the mass toward the center of the club head, which may not maximize the peripheral weight of the club head or the MOI. Moreover, most cylindrical weight members are attached to the club head via threaded engagement; during normal play, the cylindrical weights may rotate and become unintentionally disengaged from the club head.

As previously stated, a concern for higher handicap golfers is the tendency to "slice," which in addition to deviating the ball to the right also imparts a greater spin to the ball, further reducing the overall ball distance. To reduce this tendency, the '190 patent teaches the placement of weight elements directly into the club head. The placement of weight elements is designed so that the spin of the ball will be reduced, and also a "draw" (a right-to-left ball flight for a right-handed golfer) will be imparted to the ball flight. This ball flight pattern is also designed to help the distance-challenged golfer because a ball with a lower spin rate will generally roll a greater distance after initially contacting the ground than would a ball with a greater spin rate.

Alternative approaches for moving the center of gravity of a golf club head rearward and downward in the club head utilize composite structures. These composite structures utilize two, three, or more materials that have different physical properties including different densities. By positioning materials that provide the desired strength characteristics with less weight near the crown or top line of a golf club head, a larger percentage of the overall weight of the golf club head is shifted towards the sole of the club head. This results in the center of gravity being moved downward and rearward. This approach is advantageously applicable to muscle back iron clubs or fairway woods, as this will help to generate loft and power behind and below the ball. An example of this type of composite club head is shown in U.S. Pat. No. 5,720,674. The club head of the '674 patent comprises an arcuate portion of high-density material bonded to a recess in the back-skirt. Because composite materials like those found in the '674 club head must be bonded together, for example by welding, swaging, or using bonding agents such as epoxy, they may be subject to delamination or corrosion over time. This component delamination or corrosion results in decreased performance in the golf club head and can lead to club head failure.

In addition to the performance and weight characteristics, aesthetic considerations are often another important factor in golf club head design. With the rapid interest of the consuming public in the customization of golf clubs, it has become ever more important for all components of a golf club to have some sort of customizable features. Although the majority of customization within the industry of golf clubs currently occurs in the shaft, the ability to customize the appearance of a golf club head may also be of great interest to the consuming public.

Even more important than the ability of customization of a club head is the ability of an end user to customize a golf club head without the need for heavy, complicated, and burdensome tools that are traditionally only available to the manufacturing companies. Currently in the art, there are no golf club heads that are capable of having the appearance changed by the end user while also being able to adjust for performance characteristics simultaneously. Moreover, having such an interchangeable removable panel could significantly reduce production and manufacturing costs due to the ability to build a blank base golf club head that could be customized using interchangeable panels.

Though many methods of optimizing the mass properties of golf club heads exist, there remains a need in the art for a golf club head comprising at least a movable weight having secure attachment means and a low-profile such that the weight does not protrude into the center of the club head and negatively affect the location of the center of gravity. Moreover, there is a need in the art for such a movable weight capable of altering the aesthetics of the golf club head suited for the end user without the need for heavy and burdensome tools while also being capable of adjusting the performance characteristics via adjustable weights.

SUMMARY OF THE INVENTION

The present invention is directed to a metal wood or utility-type golf club head having a sole comprising at least one removable weight member. The removable weight member is preferably located toward the back of the sole and may be substantially centered between the heel and toe of the club head. Alternatively, the removable weight member may be situated toward the back and heel or toward the back and toe of the club head, depending on the desired mass characteristics, e.g., center of gravity, loft and moment of inertia, of the club head. Preferably, the weight members are connected to the club head by non-threaded means.

The removable weight member has an area or areas of concentrated mass along its plan area (PA), or surface area. These areas of concentrated mass may be situated at any location along the plan area of the weight member, depending on the desired mass characteristics of the club head. Alternatively, the area(s) of concentrated mass can be concurrent with the PA.

The removable weight member also has a low profile preferably to match the curvature or to the surface of the sole. The PA of the weight member is preferably significantly greater than its thickness, resulting in a weight member that resembles a thin chip or wafer. This design allows the mass added by the weight member to be spread substantially along the surface of the sole, as opposed to the interior of the club head, and maintains the center of gravity of the club head below and behind the center of the hitting face.

Removable weight members of the present invention may be attached to the sole via a number of different non-threaded mechanisms. In one embodiment, a removable weight member comprises a projection containing a spring-loaded bar. Pins on either side of the spring-loaded bar engage holes in a receiving cavity of the sole to securely but releasably connect the weight member to the sole. The weight member body further comprises a dovetail which is slidably inserted into a dovetail receptacle on the sole. To remove the weight member, a tool resembling pliers may be used to depress the pins on the spring-loaded bar and the weight member may be pulled free of the receiving cavity. In another embodiment, a removable weight member may attach to the sole via a side-release buckle mechanism. In yet another embodiment, a removable weight member may attach to the sole via a universal-serial-bus (USB) connection assembly.

The removable weight member preferably comprises a material having a density greater than the density of the material comprising the sole. Alternatively, the removable weight member may comprise the same material as the sole, however having a greater thickness than the average thickness of the sole. The removable weight member may comprise metals, e.g. titanium, stainless steel, or tungsten, composite or polymeric material. The removable weight member may alternatively comprise any material having a density appropriate to optimize the mass characteristics of the club head.

The removable weight member may also take on the shape of a panel in accordance with an alternative embodiment of the present invention. The removable panel may generally be comprised of a plastic, aluminum, magnesium, titanium, steel, tungsten, or any other material that will give the removable panel different weighting characteristics than the golf club head. In addition to the removable panel being constructed out of a different material, removable panel may also have specific weight receptacles to further allow weight adjustment purposes within the golf club head.

In addition to the weighting characteristics, the removable panel may also contain an easy quick disconnect interchangeable mechanism that allows an end user to easily change out the removable panel without the need for professional tools or machines. These removable panels may also contain a decorative exterior independent of the weighting characteristics that allows the end user to change out these removable panels for decorative purposes.

BRIEF DESCRIPTION OF THE DRAWINGS

FIG. 10 is a two-dimensional numerical model of a golf club head sole having a constant density;

FIGS. 11-15 are two-dimensional numerical models of a golf club head sole having concentrations of mass located toward the back and substantially centered with respect to the heel and toe;

DETAILED DESCRIPTION

The golf club head of the present invention is preferably a metal wood or utility-type club head comprising a hosel, hitting face, crown, sole, and skirt disposed between the crown and sole. The golf club of the present invention further comprises a back, opposite the hitting face, and a heel and toe portion. The inventive golf club head also has a flat profiled weight member, a panel shaped weight member, or chip disposed proximate to the aft section of the club head.

Figure 1:
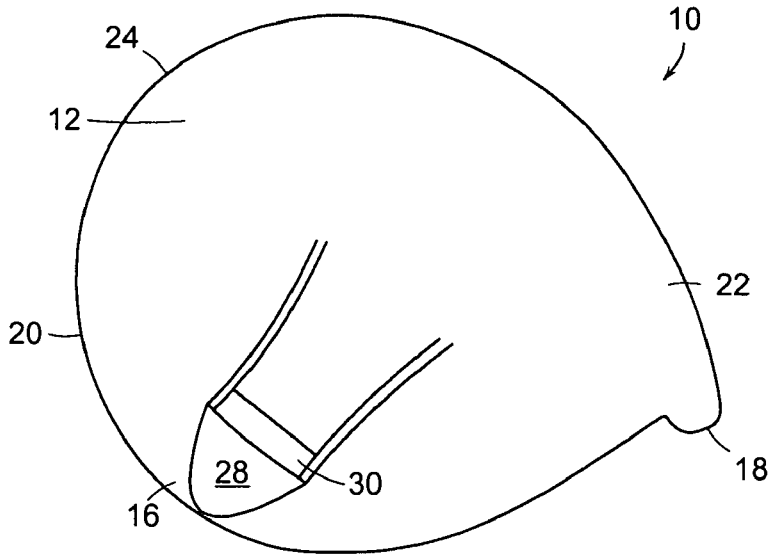
FIG. 1 is a bottom plan view of a golf club head of the present invention including a removable weight member.

An exemplary club head is shown FIG. 1. Club head 10 comprises sole 12, a crown (not shown), back 16, hosel 18, skirt 20, heel 22, toe 24, hitting face 26 (not shown) and movable weight chip 28. Sole 12 further comprises docking station 30, into which movable weight chip 28 is received and fixedly attached. Docking station 30 is preferably located substantially toward back 16 in order to position chip 28 behind and below the geometric center of club head 10. The inclusion of weight chip 28 in this location allows the center of gravity of the club head to be rearward of and lower than the center of hitting face 26, which in turn provides for greater loft and a larger "sweet spot." In addition, the moment of inertia (MOI) of the club head in the vertical direction through the geometric center of the center of gravity of the club head is increased relative to the MOI of a club head comprising a sole having a constant density, reducing distance and accuracy penalties associated with off-center hits.

Figure 3:
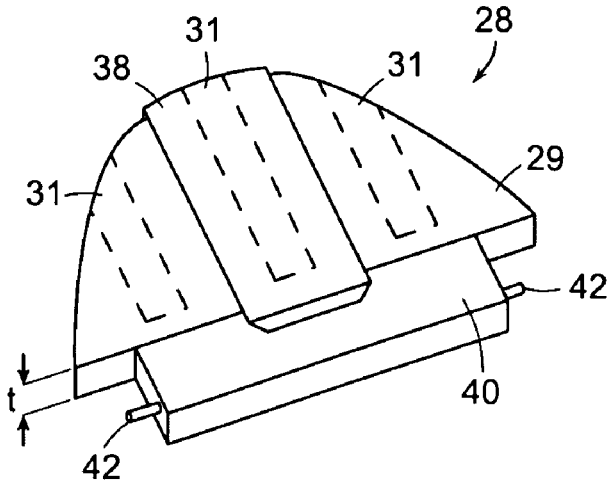
FIG. 3 is a perspective view of the weight member shown in FIG. 1.
Figure 4:
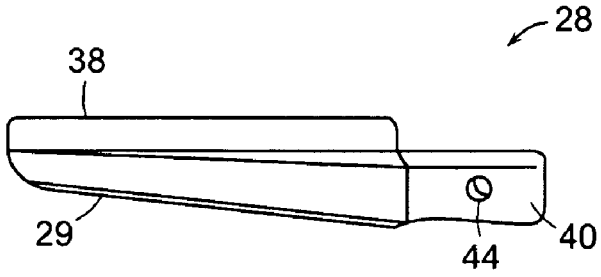
FIG. 4 is a side plan view of the weight member of FIG. 3.
Figure 5:
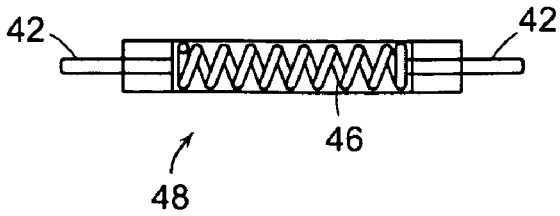
FIG. 5 is a top plan view of a spring-loaded bar with the top surface removed to show the interior of the part.
Figure 6:
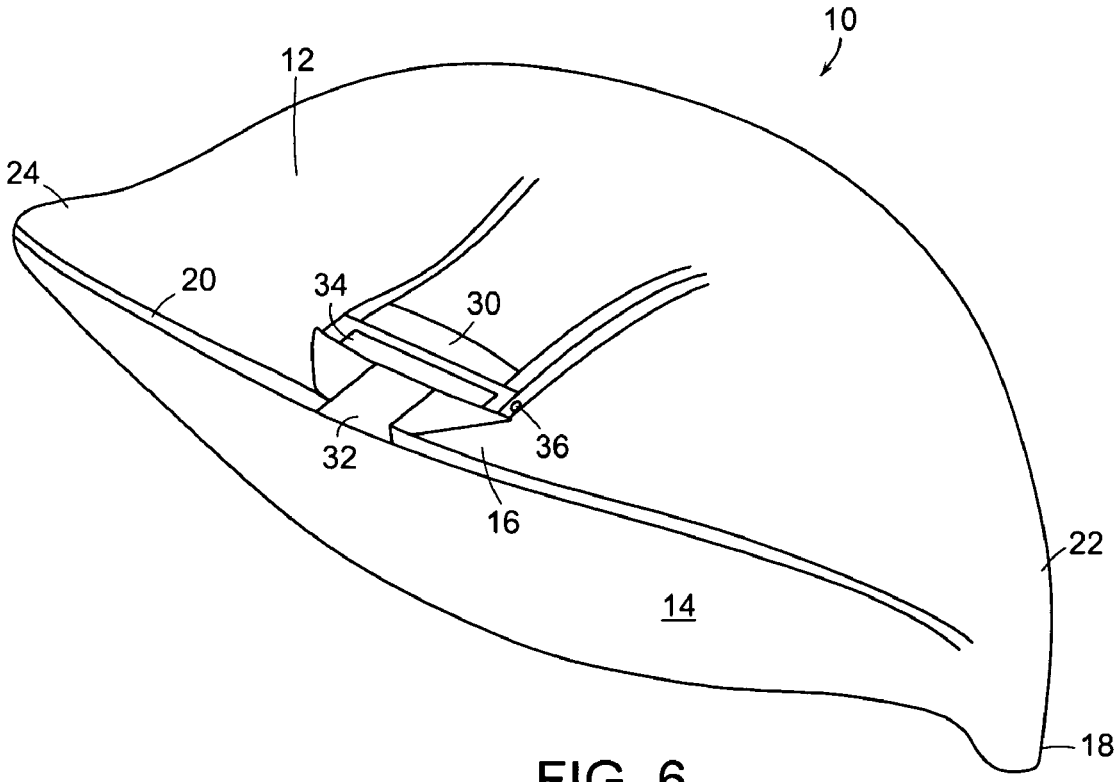
FIG. 6 is a perspective view of the golf club head of FIG. 2.

In accordance with this embodiment, docking station 30 may be raised relative to the surface of sole 12 in order to provide room for the attachment mechanism responsible for fixedly attaching weight chip 28 to docking station 30. In other embodiments of the present invention, docking station 30 may be flush with the surface of sole 12. Docking station 30 can be more clearly seen in FIGS. 2 and 6. In both figures, club head 10 is shown without weight chip 28. Referring to FIG. 6, docking station 30 comprises dovetail receptacle 32, cavity 34 and bores 36 located on either side. According to this embodiment, weight chip 28 attaches to docking station 30 similar to the attachment of a watchband to a watch face. Dovetail 38 of weight chip 28, shown in FIGS. 3 and 4, is inserted into dovetail receptacle 32 of docking station 30. The resulting dovetail joint prevents weight chip 28 from lifting out of docking station 30. To more securely attach weight chip 28, projection 40 on the chip is inserted into cavity 34. Tube 44 disposed within projection 40 contains spring-loaded bar 48, which in turn comprises spring 46 connected to pins 42. With spring-loaded bar 48 loaded into tube 44, projection 40 is inserted into cavity 34 by first inserting one side of projection 40 at an angle such that a first pin 42 engages a first bore 36 in cavity 34. With first pin 42 engaged, second pin 42 is manually depressed, for instance with the blade of a pocket knife, and the other side of projection 40 is inserted into cavity 34. The device depressing second pin 42 is moved away as the other side of projection 40 is entering cavity 34 so as to allow second pin 42 to release and engage second bore 36, in the same manner that a watch band is attached to a watch face. Spring-loaded bar 48 may also include elastomeric rod, which can replace spring 46.

Figure 7:
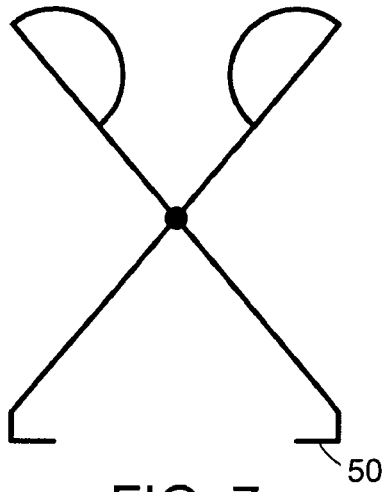
FIG. 7 is a top plan schematic view of a tool used to remove a weight member from a golf club head of the present invention.

To remove weight chip 28 from docking station 30, a tool, such as the one shown schematically in FIG. 7, may be used to disengage pins 42 from bores 36. The tool may be similar to a plier and may comprise pincers 50. A user opens the tool to position pincers 50 on either side of bores 36, then squeezes the tool at the handle to engage pincers 50 in bores 36. Pincers 50 are sized and dimensioned to depress pins 42 so that they are no longer engaged in bores 36. Weight chip 28 may then be slidably removed from docking station 30.

Weight chip 28 may also be retained by one or more set screws that threadedly engage projection 40 through the sole or through docking station 30. Weight chip 28 may be removed by removing the set screw with an Allen-wrench or screwdriver. Weight chip may also have one spring-loaded locking arm that can lock to a cavity or depression within docking station 30. The spring-loaded locking arm may have a live-joint action to provide the springiness to the arm.

Unlike the moveable weight members of the prior art that utilize cylindrical weights housed in ports that have been formed into the body of the club head, weight chip 28 has a low profile, allowing its weight to be spread substantially along the surface of sole 12. The attachments means of weight chip 28, i.e. dovetail receptacle 32 and cavity 34, are located substantially on the surface of sole 12, as opposed to in the interior of the club head. This configuration allows the center of gravity to remain behind and below the geometric center of the hitting face and more efficiently increases MOI, as mass is located at the maximum distance from the axis of rotation of the club head, as illustrated in Table 1 below. Cylindrical weight members housed in ports or cavities formed in the body of the club head, such as those disclosed in U.S. Pat. No. 7,186,190, are necessarily located on the interior of the club head and thus closer to the geometric center or center of gravity, and hence cannot increase MOI as efficiently. Further, the cavities themselves comprise a housing which adds mass to the interior of the club head, once again drawing the center of gravity toward the center of the club head and hindering the optimization of the MOI. Furthermore, the inventive attachment means do not use threaded connectors, as discussed herein.

An exemplary two-dimensional sole is modeled in FIGS. 10-15. The sole has a surface area of 215.5 $cm^2$ and a mass of 50.0 g in each of the models illustrated in FIGS. 10-15. FIG. 10 shows a sole having a constant density, in which 50.0 g are spread evenly between the 479 cells which make up the model. The calculated MOI of the sole of FIG. 10 is 9,357.7 $g \cdot cm^2$. In FIGS. 11-14 the sole includes a discrete area of concentrated mass, each discrete area totaling 5.0 g but having various shapes and plan areas (PA).

Figure 19A:
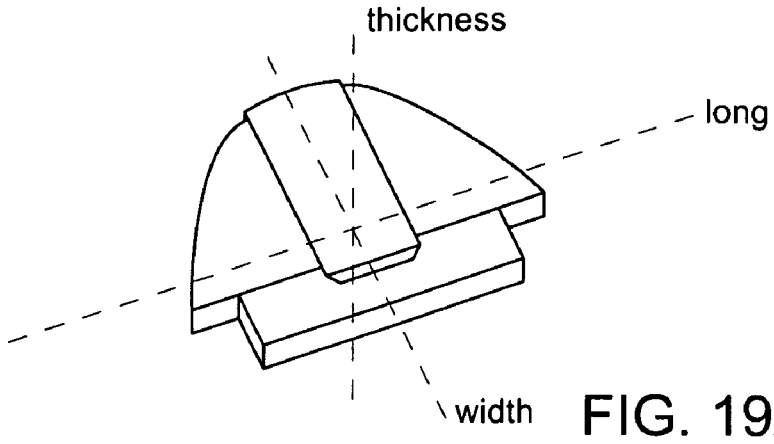
FIG. 19A and FIG. 19B are perspective views of the inventive removable weight members relative to a three-dimensional reference system.
Figure 19B:
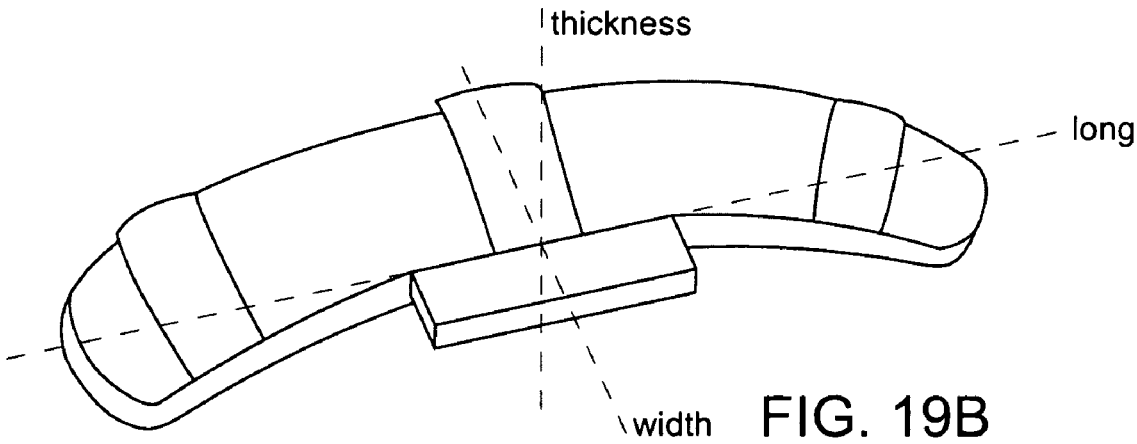
Figure 19C:
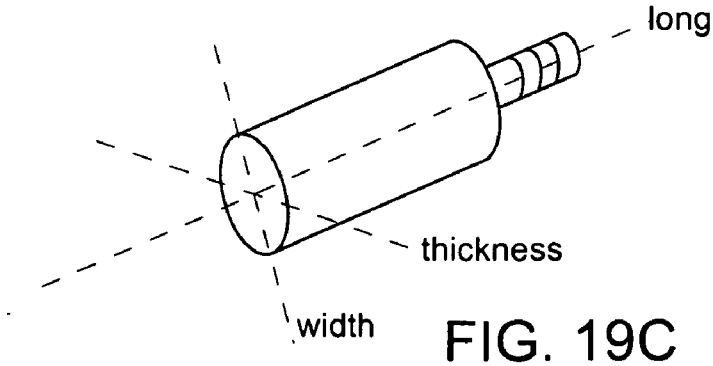
FIG. 19C (Prior Art)
FIG. 19C is a perspective view of a conventional weight insert relative to the same reference system.

PA is defined with reference to FIGS. 19A-19C, and a three-dimensional reference Cartesian coordinate system. Weight inserts including weight chip 28 are three-dimensional objects. As used herein, the dimension with the longest length shall be defined as the longitudinal axis and two orthogonal axes are defined relative to the longitudinal axis. The longer length of these two orthogonal axes shall be the width axis and the shorter length shall be the thickness axis. The PA is the maximum amount of two-dimensional surface that is projected on to a plane defined by the longitudinal axis and width axis of the weight chip as a stand-alone entity without reference to the club head. FIG. 19A shows inventive weight chip 28 relative to this definition. FIG. 19B shows inventive weight chip 328 discussed below relative to this definition, and FIG. 19C shows a conventional cylindrical weight insert with a threaded connection relative to this definition.

The effective thickness of the weight insert is defined as $$t_{eff} = \text{Volume of insert/PA}$$

In accordance with the position of weight chip 28 in FIG. 1, each discrete area of mass in FIGS. 11-14 is located toward the back of the sole and substantially centered between the heel and toe. FIG. 15 is a 2-D representation of a golf club's sole incorporating a conventional cylindrical weight, such as the one illustrated in FIG. 19C, disposed within the club head, as discussed above. Though the model of FIG. 15 provides values for a 2-D sole, it suggests strongly that a cylindrical weight member disposed toward the center of the club head, as shown in FIG. 15 and as seen in the prior art, does not increase MOI as effectively as the inventive mass distributions shown in FIGS. 11-14 and disclosed herein.

The following table summarizes the mass characteristics of the sole modeled in FIGS. 10-15 and illustrates the increase in MOI achieved by concentrating mass in the periphery of the sole, away from the center of gravity and axis of rotation of the club head. Table 1 provides the mass (m) of the discrete area of concentrated mass located on the inventive sole, the plan area (PA) of the discrete area of concentrated mass, the mass (m) of each cell that comprises the discrete area of concentrated mass, and the moment of inertia (MOI) of the entire sole.

| | m (discrete area) [g] | PA (discrete area) [$cm^2$] | m per cell of discrete area [g] | MOI [$g*cm^2$] |
|---|---|---|---|---|
| FIG. 10 (uniform mass distribution) | — | — | — | 9,357.70 |
| FIG. 11 | 5.0 | 4.05 | 0.56 | 10,382.12 |
| FIG. 12 | 5.0 | 5.40 | 0.42 | 10368.86 |
| FIG. 13 | 5.0 | 6.75 | 0.33 | 10328.64 |
| FIG. 14 | 5.0 | 7.20 | 0.31 | 10332.26 |
| FIG. 15 (cylindrical weight insert) | 5.0 | 7.20 | 0.31 | 9,522.18 |

Alternatively, weight chip 28 and docking station 30 can be located elsewhere on club head 10. For example, weight chip 28 and docking station 30 can be located at the heel, toe or the back of the club head. Furthermore, a plurality of weight chips 28 and docking stations 30 can be utilized and located around the club head. More specifically, a number of docking stations 30 can be located proximate the heel, toe and back, and one weight chip 28 (or more) can be selectively deployed at any of the available docking stations to alter the mass characteristics of the club head. The unused docking stations can be filled with "dummy" chips, i.e., chips having substantially similar shape as weight chip 28 but without having a specific gravity higher than the specific gravity of the sole. Dummy chips can be made out of polymeric materials with specific gravities substantially lower than that of the sole of the club head.

Weight chip 28 preferably comprises a material having a density greater than the density of the material comprising sole 12. Alternatively, weight chip 28 may comprise the same material as sole 12, however having a greater thickness than the average thickness of sole 12. In other words, the weight per unit area or the "basis weight" of weight chip 28 is greater than that of sole 12. Weight chip 28 may comprise metals, e.g. titanium, stainless steel, or tungsten. Alternatively, weight chip 28 may comprise composite or polymeric material with or without high specific gravity fillers or flakes, such as tungsten or metal powders. Weight chip 28 alternatively comprises any material having a density appropriate to optimize any desired mass property including the location of the center of gravity in terms of height and depth and the various components of moment of inertia ($I_{shaft}$, $I_{xx}$, $I_{zz}$ and $I_{yy}$) By concentrating mass in weight chip 28, weight chip 28 increases the moment of inertia of the club head relative to a club head having a sole with constant density. The areas of higher density or greater thickness, i.e., higher weight per unit area or higher basis weight, may occupy all or part(s) of weight chip 28. Such areas can be referred to as areas of concentrated mass, discussed further below.

Preferably, the basis weight of weight chip 28 (or portions thereof) is at least about 1.5 times the basis weight of sole 12, more preferably at least about two times and most preferably at least three times the basis weight of sole 12.

As shown in FIG. 3, projection 40 of weight chip 28 may comprise a material having a lower density or mass relative to the density or mass of body 29. Docking station 30 may also comprise a lightweight material and may have a density or mass less than the density or mass of surrounding sole 12. Projection 40 and docking station 30 may comprise such materials as aluminum, titanium, magnesium, stainless steel, composite, or polymeric material.

For purpose of comparison only, the PA of a conventional cylindrical weight insert, such as those illustrated in FIGS. 15 and 19C would be the projection of a cylinder onto a flat plane, which would be a rectangular area. The PA of a screw with a screw head would be the projection of the screw along its length onto a flat plane. The effective thickness of such cylindrical weight insert or screw is the volume of such object divided by the PA.

Preferably, weight chip 28 has a plan area of about 4 $cm^2$ and an effective thickness of about 0.5 cm. More preferably, weight chip 28 has a plan area of about 6 $cm^2$ and an effective thickness of about 0.3 cm. Most preferably, weight chip 28 has a plan area of about 7 $cm^2$ and an effective thickness of about 0.3 cm. Referring to chip ratio of weight chip 28 (plan area/thickness), weight chip 28 preferably has a chip ratio greater than about 8. More preferably, weight chip 28 has a chip ratio greater than about 14, and most preferably, weight chip 28 has a chip ratio greater than about 20. The volume of weight chip 28 refers to the plan area multiplied by the effective thickness, and preferably comprises about 3% or less, preferably about 2% or less, or about 1% or less of the volume of club head 10. Hence, since the USGA maximum volume for driver club heads is 460 cc and the preferred volume for the chip is about 1% volume, the volume of chip 28 should be less than 4.6 cc for driver clubs.

In an alternative embodiment, projection 40 may contain higher density or high specific gravity material, while body 29 may contain lower density or lower specific gravity material. Furthermore, chip 28 may be inserted from the direction from the perimeter of club head toward the center of the club head, as shown, or in the opposite direction, or any other orientation.

The center of gravity and MOI of club head 10 may be optimized, depending on the needs of the golfer, by altering the position of docking station 30 during manufacture. To fabricate a club head having a center of gravity rearward and below the center of hitting face 26 but substantially centered with respect to heel 22 and toe 24 of club head 10, docking station 28 may be located toward the back of sole 12 and centered with respect to the heel and toe. Alternatively, docking station 30, and hence weight chip 28, may be positioned toward toe 24 to create a club head having a tendency to remain open at impact with a golf ball. In another embodiment of the present invention, docking station 30 may be located toward heel 22 so that hitting face 26 has a tendency to be closed upon impact with a golf ball.

Figure 8:
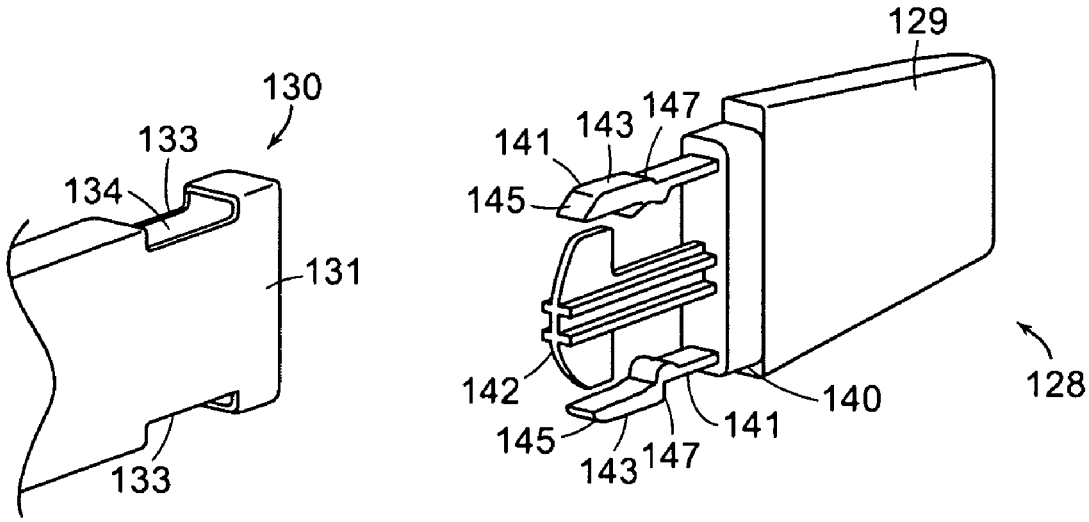
FIGS. 8 and 9 are exploded perspective views of a weight member and receptacle for said weight member, said receptacle shown separated from the sole of a golf club head.

Sole 12 may also comprise more than one weight chip 28. For instance, two weight chips may be positioned at the back of sole 12, one toward the heel and one toward the toe. In another embodiment, three or more weight chips may be utilized. Preferably, the weight chips attach to sole 12 via the attachment mechanism illustrated in FIGS. 1-6. Alternatively, the weight chip may attach to sole 12 via the assemblies taught below and in FIGS. 8 and 9. As stated above, one or more weight chip 28 could be un-weighted, i.e., a dummy chip. A place holder or a cap can be deployed in unused docking stations 30.

One advantage of the weight chip of the present invention is that it can be utilized to control the swing weight of the clubs in the set. Swing weight is related to the weight of a club head and to the length of the shaft. For example, a 3-iron may weigh 240 grams while a wedge may weight 290 grams, but since the shaft of the 3-iron is longer than the shaft of the wedge both clubs may have the same swing weight. It is preferred that the swing weights for a set of irons are substantially similar. Weight chips 28 can be utilized in irons to adjust the swing weight of iron clubs. Weight chips 28 can also be used to adjust the swing weight of a driver, e.g., by changing a chip of 1 gram for a chip of 4 grams.

In accordance with this invention, other means of attaching a removable weight member to sole 12 may be utilized. In one embodiment, illustrated in FIG. 8, removable weight chip 128 and docking station 130 (shown separated from sole 12) may comprise a side-release buckle mechanism, such as the one taught in U.S. Pat. No. 4,150,464, which is incorporated herein by reference in its entirety. Exemplary removable weight chip 128 includes body 129 and projection 140, which comprises resilient arms 141 and rigid arm 142 situated between resilient arms 141. Resilient arms 141 further comprise raised lateral edges 143 and leading edges 145. Docking station 130 comprises housing 131 in which cavity 134 resides. Housing 131 further comprises slots 133. As weight chip 128 is pushed into cavity 134, leading edges 145 meet housing 131 and cause resilient arms 141 to compress slightly, allowing resilient arms 141 to be pushed further into cavity 134. Weight chip 128 is securely attached to docking station 130 once raised lateral edges 143 enter slots 133. Resilient arms 141 decompress and return to their normal position. Trailing edges 147 meet the edge of slots 133 and prevent weight chip 128 from sliding out of docking station 130. Body 129 may include a dovetail to engage dovetail receptacle 32 of sole 12. Weight chip 128 may be released from housing 131 by depressing resilient arms 141, exposed at raised lateral edges 143 through slots 133, while pulling rearward on body 129. This method of attachment is substantially the same as the "buckle" attachments for backpacks and the like.

Figure 9:
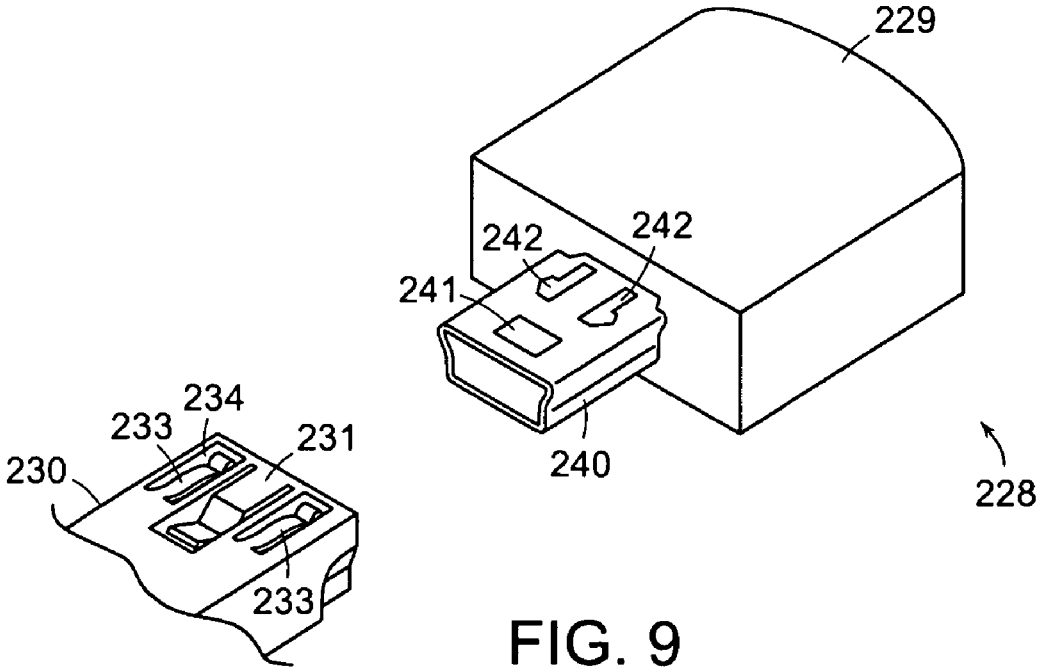

In another embodiment of the present invention, shown in FIG. 9, removable weight chip 228 and docking station 230 mate as in a universal-serial-bus (USB) electronic connection assembly. An example of such a connection assembly is taught in U.S. Pat. No. 6,902,432. In accordance with this embodiment, weight chip 228 comprises body 229 and projection 240. Docking station 230 (shown separated from sole 12) comprises cavity 234, central tongue 231 and lateral tongues 233. Cavity 234 is slightly larger than projection 240 so that projection 240 may be inserted into cavity 234. As projection 240 is pushed into cavity 234, the inclined planes of central tongue 231, which form a "v" shaped depression, enter opening 241 of projection 240. Simultaneously, the inclined planes of lateral tongues 233 enter slots 242. The mating of central tongue 231 to opening 241 and lateral tongues 233 to slots 242 create a secure but releasable connection between weight chip 228 and docking station 230. Body 229 may include a dovetail to engage dovetail receptacle 32 of sole 12. Alternatively, for USB connections the chip may comprise a memory device such as EEPROM, EPROM or flash drive to store information relating to the impacts between club and balls. In one example, a sensor measuring torque and/or vibration can be inserted into the club head, preferably at the hitting face and measurements from the sensor can be written on the memory device through the USB connection by a controller. The chip can be removed and attached to a reader, such as a laptop or smart phone and the data can be conveyed to the golfer. High torque or high vibration may indicate off-center hits, and statistical analysis can be provided to the golfer. A suitable sensor can be a piezoelectric device comprising an accelerometer, described and claimed in commonly-owned, co-pending patent application Ser. No. 11/979,787 filed on Nov. 8, 2007, which is incorporated by reference in its entirety.

Other suitable attachment mechanisms include those described in or can be derived from commonly owned, co-pending patent application Ser. No. 11/563,224 filed on Nov. 27, 2006, which is incorporated herein by reference in its entirety.

Figure 16:
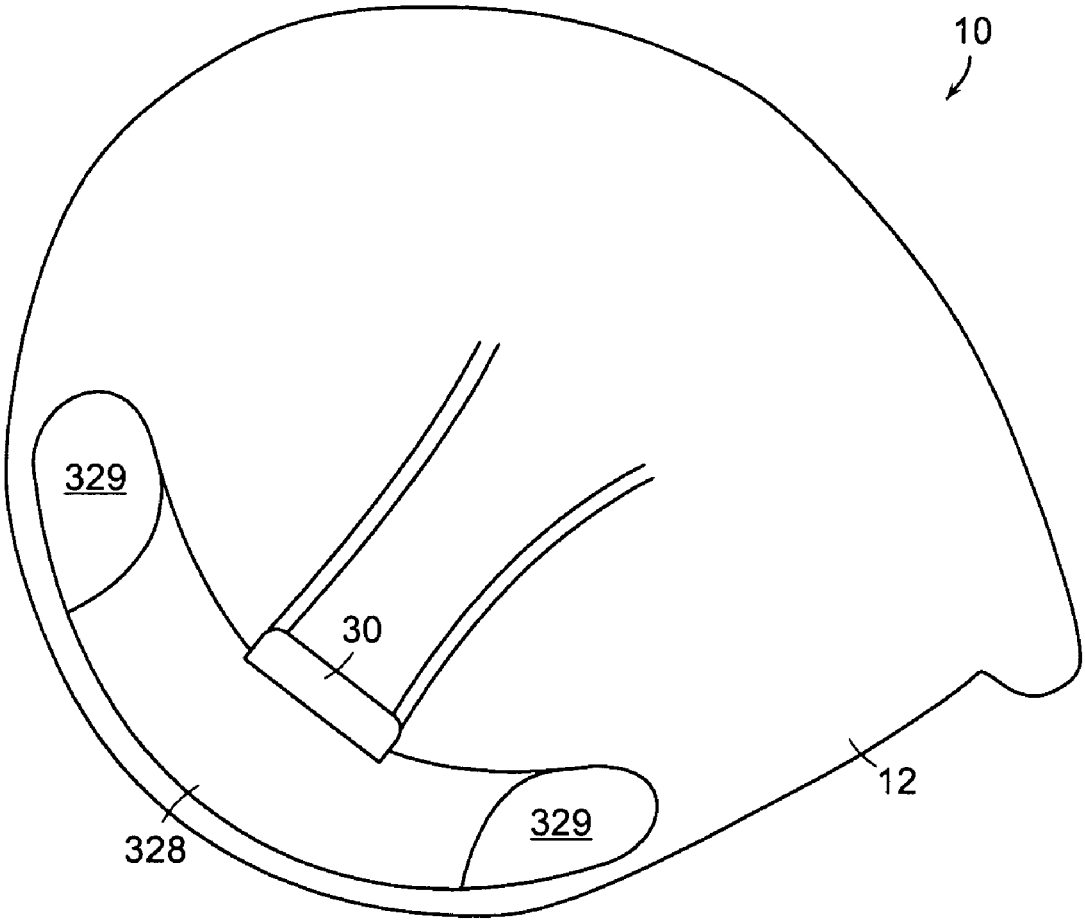
FIG. 16 is a top plan view of a golf club head of the present invention including a removable weight member.

In accordance with yet another embodiment of the present invention, sole 12 may comprise a removable weight member which has a varied mass and/or density over its plan area (PA). Referring to FIG. 16, weight chip 328 comprises a substantial portion of the back of sole 12. It is shaped such that its average length (measure in the heel-toe direction) is much greater than its average width (measured in the back-hitting face direction) so that mass is concentrated on the periphery of sole 12. Weight chip 328 includes areas 329 having greater density or basis weight than the rest of weight chip 328. In this embodiment, areas 329 are situated on the heel and toe ends of weight chip 328. In other embodiments, weight chip 328 may comprise one, two or more areas 329 of concentrated mass. Further, areas 329 may be situated at any location on weight chip 328, depending on the desired mass characteristics of golf club head 10, discussed above. In accordance with this embodiment, weight chip 328 has a plan area of about 10 $cm^2$ to about 50 $cm^2$. More preferably, weight chip 328 has a plan area of about 20 $cm^2$ to about 40 $cm^2$ and more preferably about 25 $cm^2$ to about 35 $cm^2$. Weight chip 328 preferably has an effective thickness of about 0.30 cm or less. More preferably, weight chip 328 has an effective thickness of about 0.25 cm or less. Most preferably, weight chip 328 has an effective thickness of about 0.20 cm or less. Preferably, the volume of the chip remains less than about 3%, more preferably less than about 2% or less than about 1% of the volume of the club head, e.g., less than about 4.6 cc, for a driver club head.

Figure 2:
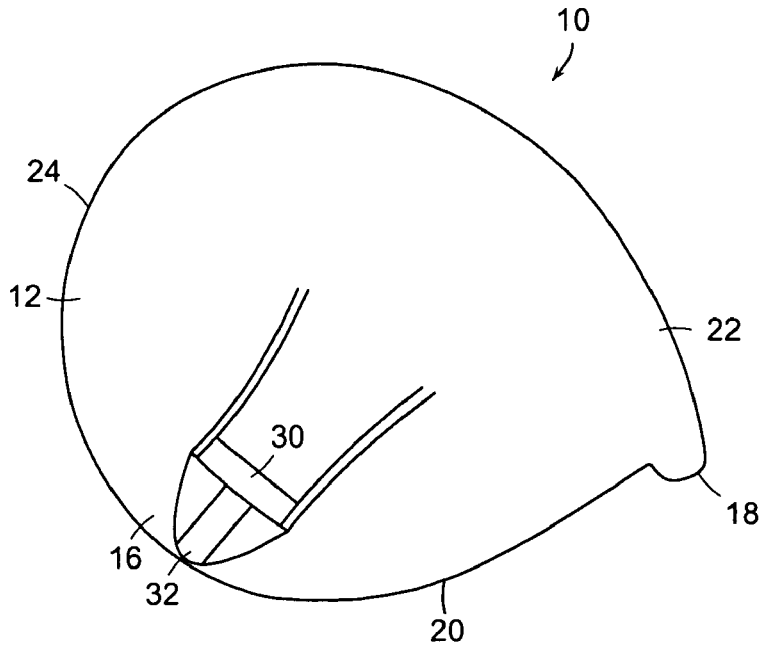
FIG. 2 is a bottom plan view of the golf club head of FIG. 1, however with the weight member removed.
Figure 17:
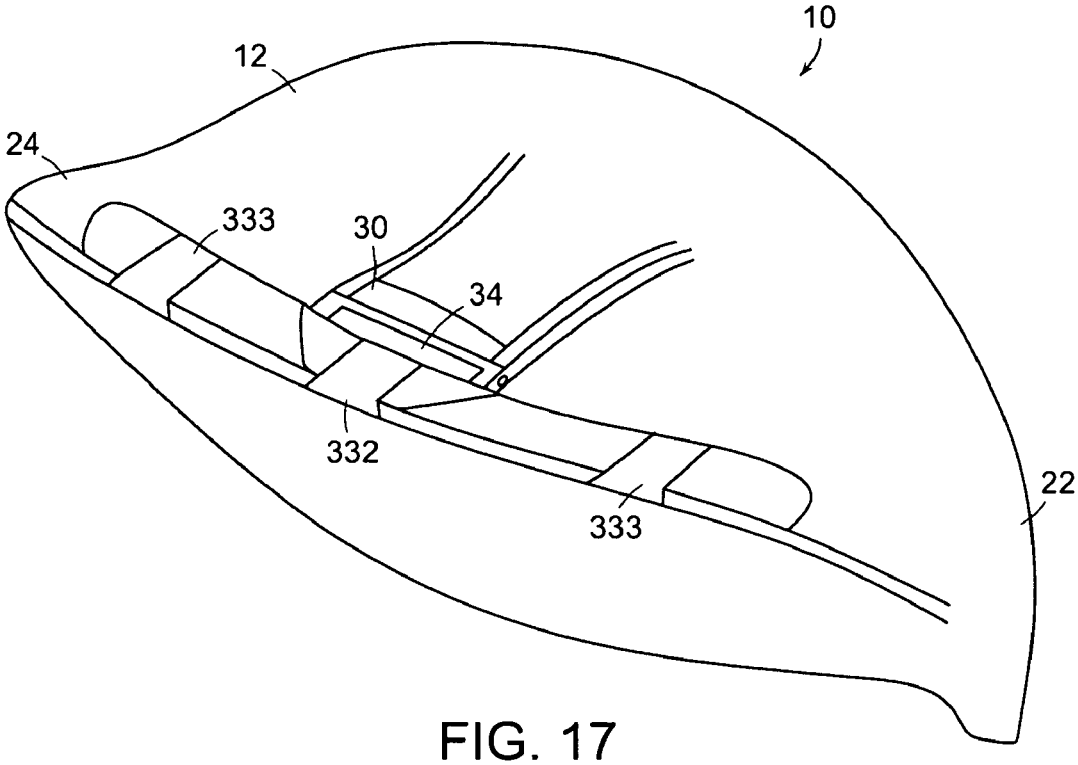
FIG. 17 is a perspective view of a golf club head of FIG. 16, however with the weight member removed.
Figure 18:
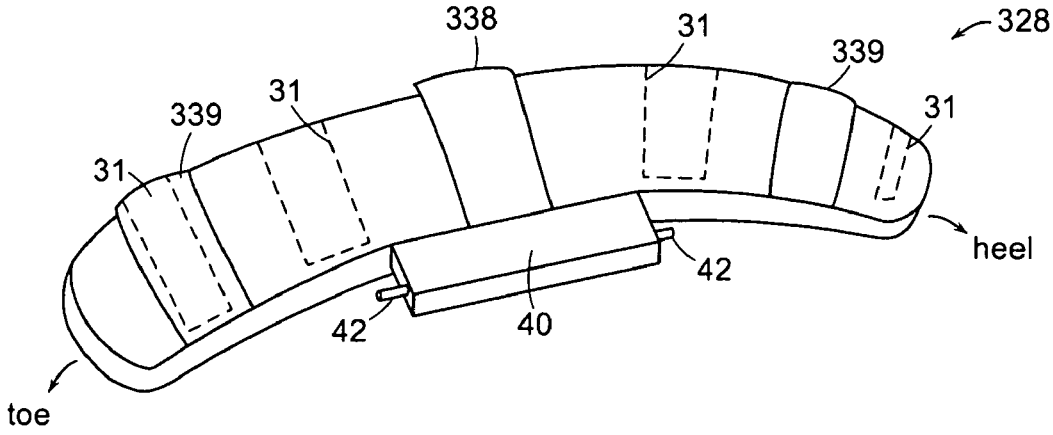
FIG. 18 is a perspective view of the weight member shown in FIG. 16.

To securely attach weight chip 328 to golf club head 10, sole 12 may comprise an attachment mechanism similar to that shown in FIGS. 1, 2 and 6. As shown in FIG. 17, sole 12 may comprise docking station 30 including cavity 34 to receive projection 40 of weight chip 328. Projection 40 and docking station 30 operate in the same fashion as illustrated FIGS. 1-6. Sole 12 may further comprise central dovetail receptacle 332 and peripheral dovetail receptacles 333 to engage central dovetail 338 and peripheral dovetails 339 on weight chip 328, as shown in FIG. 18.

In another embodiment of the present invention, chip 28, 128, 228 and 338 may contain one or more pockets 31, shown in phantom lines in FIGS. 3 and 17. Each of these pockets is sized and dimensioned to receive a concentrated weight that has a density or basis weight higher than those of the sole. Pockets 31 can have any shape, rectangular prism, diamond prism, cylindrical, etc. One advantage of this embodiment is that individual golfers may tailor the mass characteristics, discussed above, of their clubs to their own personal standards. For example, referring to FIG. 17 a golfer may choose to insert concentrated weights into pockets 31 that proximate the toe to increase MOI and swing weight and leave pockets 31 closer to the heel unused, and vice versa.

The club head may be formed by any means known to those skilled in the art. For instance, portions of the club head may be formed from cast, forged, stamped, or molded components. Any material known to those skilled in the art may be used including, but not limited to, iron, steel, aluminum, tin, vanadium, chromium, cobalt, nickel, magnesium, or alloys. In a preferred embodiment, the face, the sole, the face plate, and the support members may comprise a high strength titanium alloy such as 10-2-3 (Ti-10% V-2% Fe-3% Al) or 15-3-3-3 (Ti-15% V-3% Cr-3% Sn-3% Al). In another embodiment, the face, the sole, the face plate, and/or the support members may be produced from a different titanium alloy such as a 6-4 alloy (Ti-6% Al-4% V).

In alternate embodiments, other forging and casting alloys may be used, such as stainless steel and aluminum. By forming the face plate by stamping, forging, or casting, the face portion may be thin yet still have sufficient strength to withstand repeated impact with a golf ball without failure. In turn, by forming the desired mechanical performance standards, weight may be redistributed to other parts of the club head.

Figure 20:
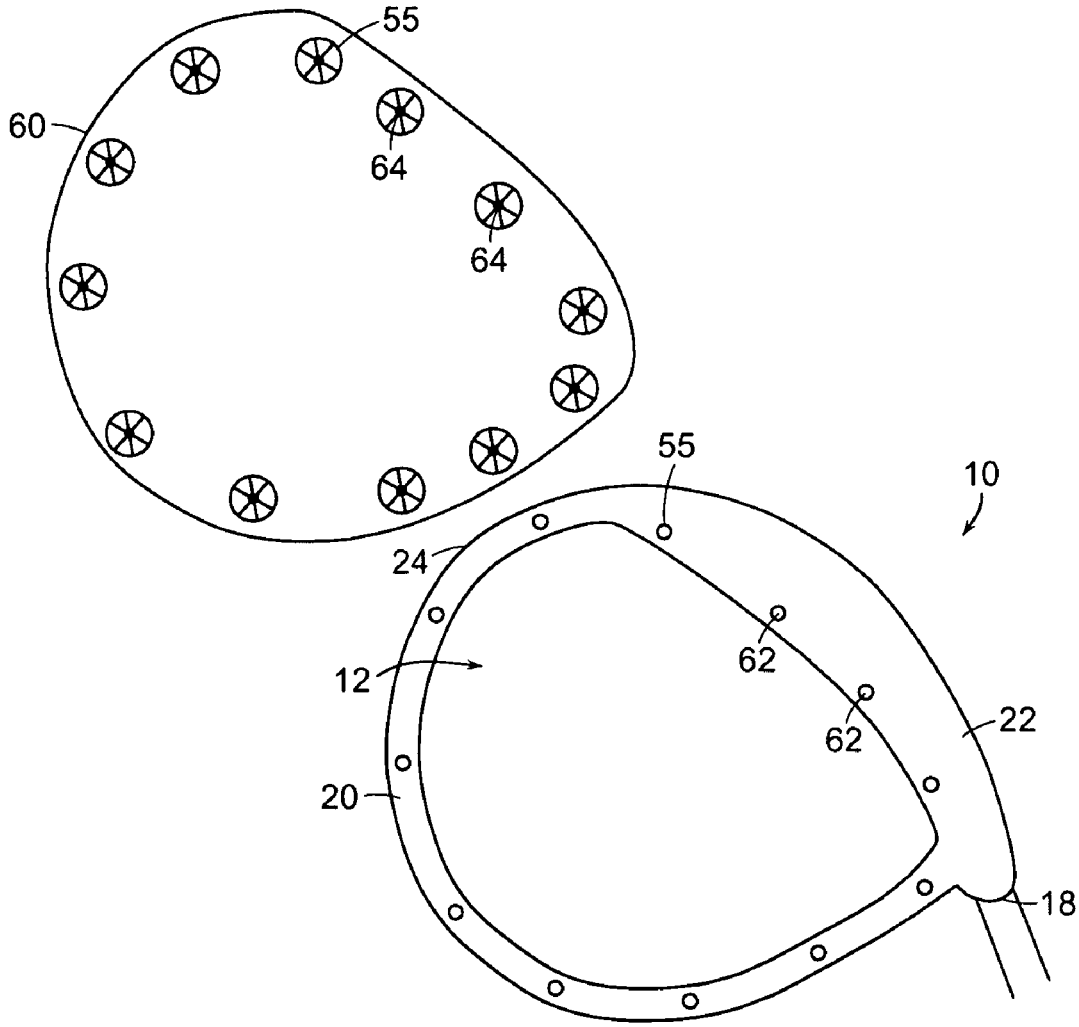
FIG. 20 is an exploded view of a further alternative embodiment of the present invention wherein said weight member is in the shape of a panel.

Turning now to FIG. 20 showing an exploded view of a golf club head 10 in accordance with an alternative embodiment of the present invention wherein a removable panel 60 may be attached to the sole 12 of club head 10. More specifically, FIG. 20 shows the removable panel 60 having a plurality of inverse bore portions 64 located around the perimeter of the removable panel 60 to attach to the plurality of bore shafts 62 located around the perimeter of the sole 12 of club head 10 to form a quick disconnect mechanism 55 (shown in more detail in FIGS. 23 and 24). In the current exemplary embodiment shown in FIG. 20, the location of the inverse bore portions 64 are scattered around the perimeter of the removable panel 60 to ensure that the removable panel 60 is securely attached to the perimeter of the sole 12 of club head 10 while minimizing vibration of the removable panel 60; however the location of the inverse bore portions 64 may be placed at any location on the golf club head 10 including but not limited to the forward portion, the aft portion, the heel 22 portion, or the toe 24 portion all without departing from the scope and content of the present invention. Relative to the location of the inverse bore portions 64, the location of the plurality of bore shafts 62 may generally be located to match the location of the inverse bore portions 64; however, a club head 10 may have more inverse bore portions 64 than bore shafts 62, or more bore shafts 62 than the inverse bore portions 64 also without departing from the scope and content of the present invention.

Unlike weight chip 28, removable panel 60 may generally be comprised of a material having a density that is lower than the density of the remainder of the club head 10 in order to generate more discretionary weight that can be strategically placed at various locations within golf club head 10. Discretionary weight, generally used to alter the center of gravity (CG) location, may be placed at the crown, sole, or even at the removable panel 60 portion of golf club head without departing from the scope of the present invention. In an alternative embodiment removable panel 60 may also be comprised of a material that has a density that is higher than the remainder of the club head 10 in order to adjust the center of gravity to be lower within the golf club head 10 without the need to create discretionary weight without departing from the scope and content of the present invention. Finally, in a further alternative embodiment of the present invention, removable panel 60 may even have the same density as the remainder of the golf club head 10 to allow center of gravity to be adjusted via other methods also without departing from the scope of the present invention.

Removable panel 60 may be comprised of a metal material such as titanium, stainless steel, tungsten, or any other material commonly used in a golf club without departing from the scope of the present invention. Alternatively, removable panel 60 may also be comprised of a composite or polymeric material with or without high specific gravity fillers or flakes such as tungsten or metal powders also without departing from the scope of the present invention.

Removable panel 60, as shown in the current exemplary embodiment may contain an aesthetic decorative design at its outer surface to enhance the visual appeal of the sole 12 of club head 10 without the need to replace the actual club head 10. This interchangeability of removable panel 60 may be advantageous, as it allows the golfer to adjust the aesthetic look and feel of the club head 10 with relative ease without departing from the scope and content of the present invention. For example, in accordance with an embodiment of the present invention, removable panel 60 may be comprised of different colors to change the aesthetic look of the golf club. Additionally, removable panel 60 may also take on various themed decorations such a birthday decoration, a graduation decoration, an anniversary decoration, a sports themed decoration, a college themed decoration, or any other decoration that could alter the aesthetic look and feel of the golf club head 10 all without departing from the scope and content of the present invention. Finally, removable panel 60 may also be customized to contain a personalized logo or message to give the golf club head 10 a personalized look and feel without having to replace the golf club head 10 itself also without departing from the scope of the present invention.

Removable panel 60, as shown in the current exemplary embodiment, may generally be sold as a complete set that could come with golf club head 10 along with one or more removable panels 60. Having a plurality of one or more removable panels 60 may generally allow a professional fitter or an end user to modify the weight panel 60 to change the performance characteristics or the aesthetic look and feel of golf club head 10 without departing from the scope and content of the present invention. Alternatively, removable panel 60 may also be sold separately from golf club head 10 to allow customization of the golf club head 10 independent of the original purchase without departing from the scope and content of the present invention.

Utilizing removable panels 60 to form the sole portion of golf club head 10 may also be advantageous in helping reduce the manufacturing costs associated with the production of golf club head 10. Because removable panels 60 are customizable and interchangeable, golf club head 10 may be constructed and manufactured without a sole, thus reducing the complexities associated with golf club head 10 production. Additionally, golf club head 10 may also be manufactured similar to a blank template from which individualized removable panels 60 may be attached, thus further simplifying the manufacturing process without departing from the scope and content of the present invention.

Figure 21:
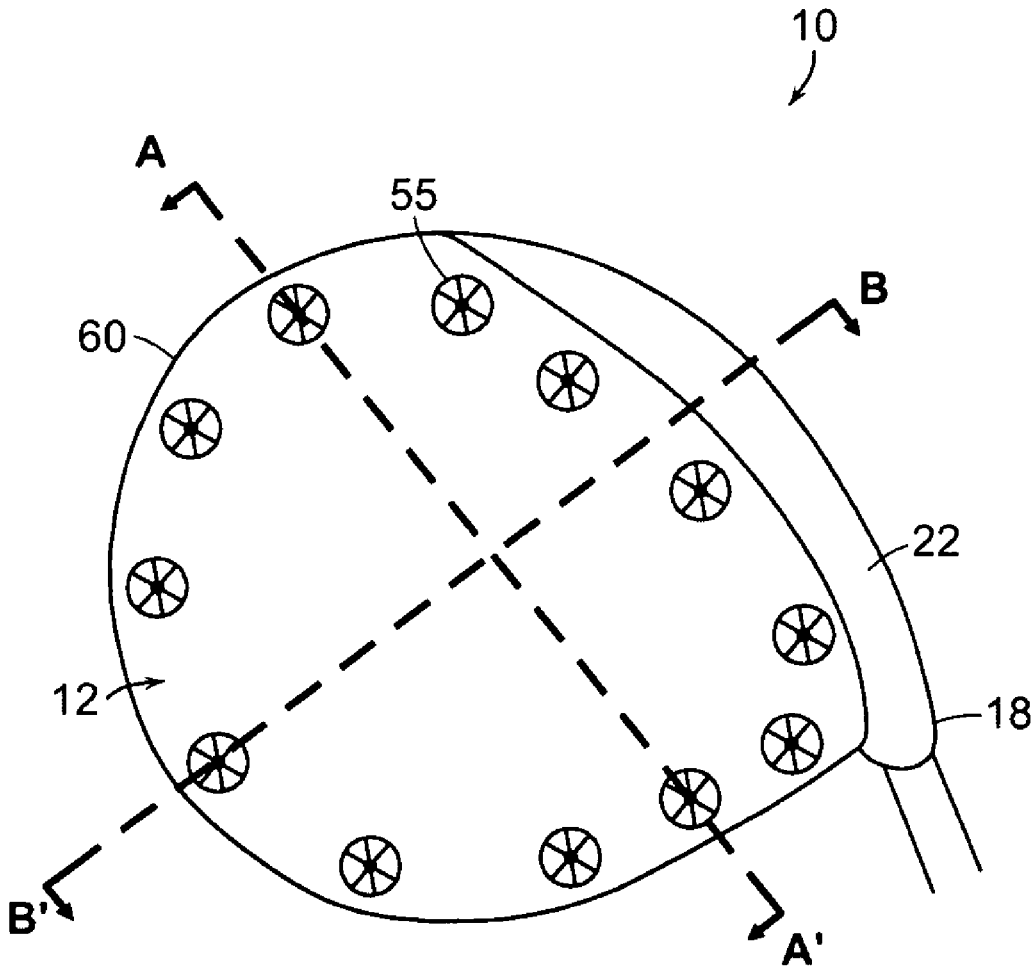
FIG. 21 is perspective view of the further alternative embodiment wherein said weight member is in the shape of a panel and attached to the golf club head.
Figure 23:
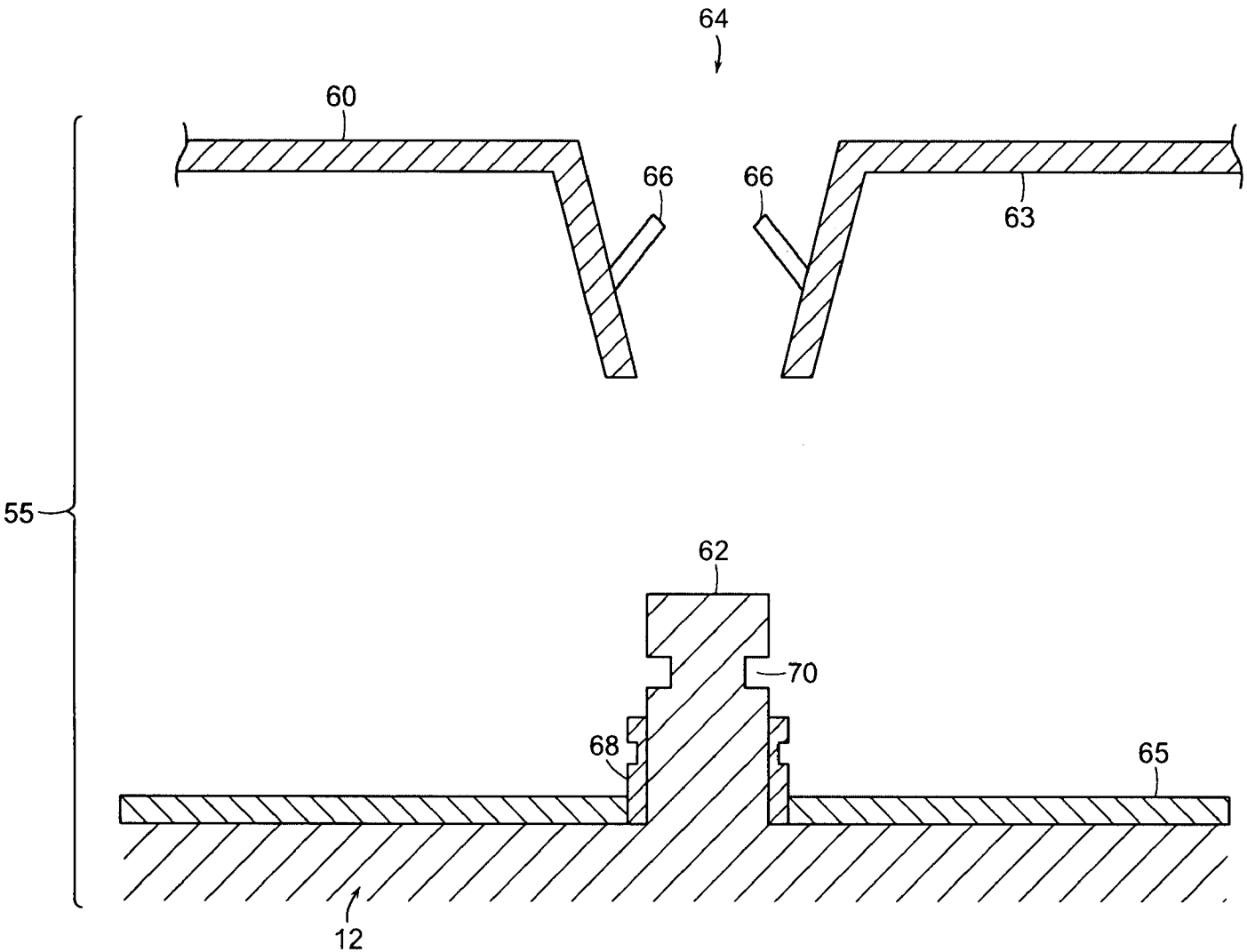
FIG. 23 is an exploded cross sectional view of the further alternative embodiment of the present invention.
Figure 24:
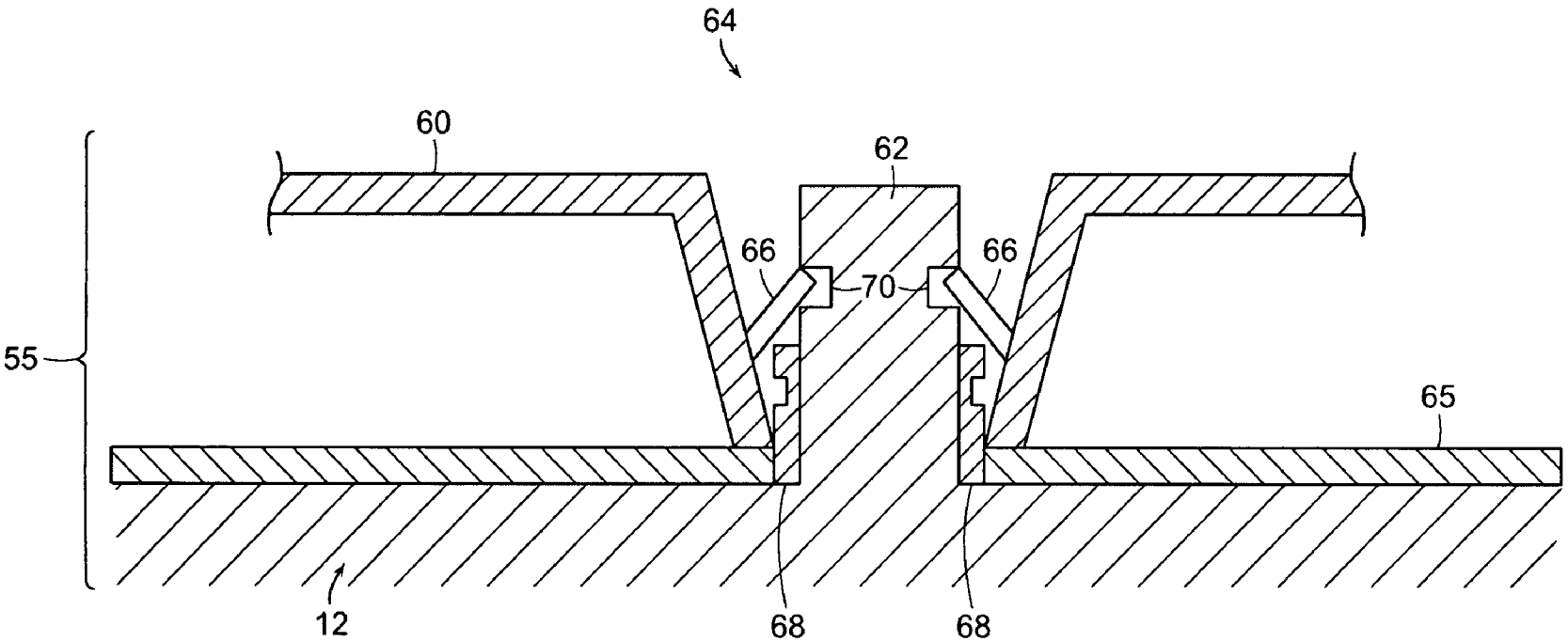
FIG. 24 is an enlarged cross sectional view of the further alternative embodiment of the present invention.

FIG. 21 shows a perspective view of the present invention wherein the removable panel 60 is attached to the sole 12 of the club head 10 utilizing the afore mentioned plurality of inverse bore portions 64 and the plurality of bore shafts 62 to form the quick disconnect mechanism 55 (as shown in more detail in FIGS. 23 and 24). FIG. 21 also demonstrates that the current invention may utilize the removable panel 60 at the sole 12 portion of the club head 10; however, removable panel 60 may also be strategically placed at various other locations on the golf club including but not limited to the crown (not shown), the skirt 20, the heel 22, the toe 24, or any partial portion thereof all without departing from the scope and content of the present invention.

Removable panel 60, as shown in the current exemplary embodiment may also contain a coating that could improve the turf interaction of club head 10 when it comes in contact with the ground. It should be noted that however, removable panel 60, could also improve turf interaction based purely on the material itself without any coating in accordance with the scope and content of the present invention. The coating for removable panel 60 may generally be a polytetrafluoroethylene type material, however, numerous other materials such as silicone, diamond like carbon coatings, or any other coating that is capable of reducing the coefficient of friction without departing from the scope and content of the present invention.

Figure 22:
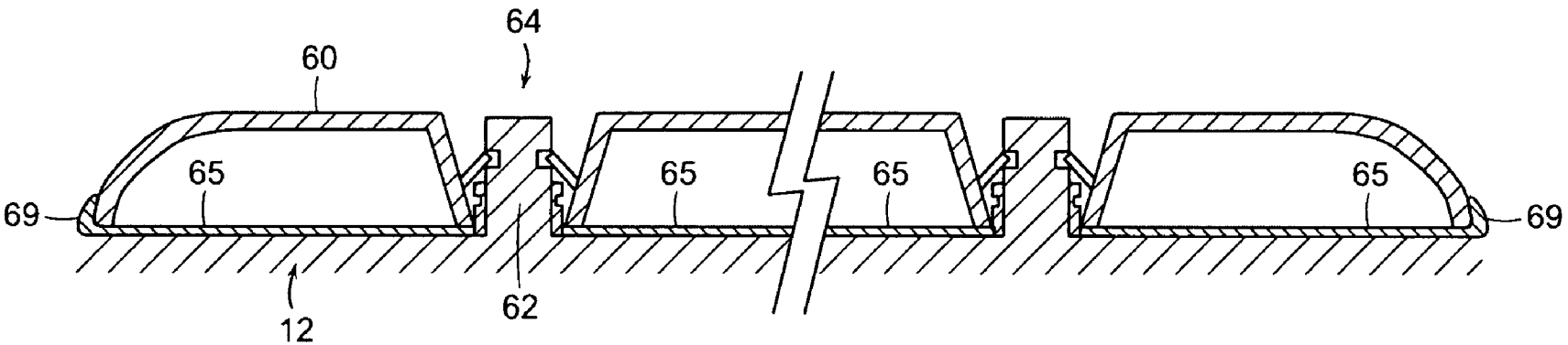
FIG. 22 is a cross sectional view of the further alternative embodiment of the present invention showing a variation of the quick disconnect mechanism.

FIG. 22 shows a cross-sectional view of an embodiment of the present invention taken along cross-sectional line A-A' as shown in FIG. 21. The cross-sectional view shown in FIG. 22 shows a vibration dampening layer 65 interposed between the removable panel 60 and the sole 12 of the club head 10. Dampening layer 65 in this current exemplary embodiment may generally be a plastic polymer material that is capable of absorbing vibrations occurring between the removable panel 60 and the sole of club head 10; however dampening layer 65 may also be comprised of silicone rubber, latex, elastomer, or any other material capable of absorbing vibrations all without departing from the scope and content of the present invention.

Dampening layer 65, as shown in the current exemplary embodiment may have in increased thickness along the outer edges 69 to receive the outer edges of the removable panel 60. The increased thickness of the dampening layer 65 at the outer edges 69 may generally allow the dampening layer 65 to wrap around the removable panel 60, as the removable panel 60 digs into the dampening layer 65. This slight curvature may generally reduce dampening and further lock in the outer edges of the removable panel all without departing from the scope and content of the present invention. The exemplary embodiment may allow the outer edges 69 of the dampening layer 65 to cover up and secure the removable panel 60 in order to prevent the outer edges of the removable panel 60 from flapping or vibrating when club head 10 comes in contact with a golf ball.

FIGS. 23 and 24 shows an enlarged view of the connection between the bore shaft 62 and the inverse bore portion 64 to form a quick disconnect mechanism 55. Quick disconnect mechanism 55 is used to removably connect a removable panel 60 to a golf club head 10. Removable panel 60 may be used to enhance the various performance characteristics of a golf club when attached to the club head 10; such characteristics include, but are not limited to, increasing the moment of inertia, adjusting the center of gravity, as well as improving the aesthetic characteristics of club head 10. Removable panel 60 comprises a flat portion 63 and at least one inverse bore portion 64. A plurality of teeth 66 is preferably angularly attached to each inverse bore portion 64 of removable panel 60 as shown. Club head 10 preferably comprises of at least one bore shaft 62, with each release collar 68 slidingly connected to a bore shaft 62. Each bore shaft 62 may also comprise of an optional first score line 70 which runs around at least a portion of the circumference of the bore shaft 62 without departing from the scope and content of the present invention.

To connect removable panel 60 to club head 10, each of the plurality of inverse bore portions 64 of the removable panel 60 is placed over each of the plurality of bore shafts 62 in the sole 12 section of the club head 10. As the removable panel 60 is lowered over each of the bore shaft(s) 62, teeth 66 will make contact with the outside of bore shaft 62 at the first score line 70, locking in the removable panel.

Figure 25:
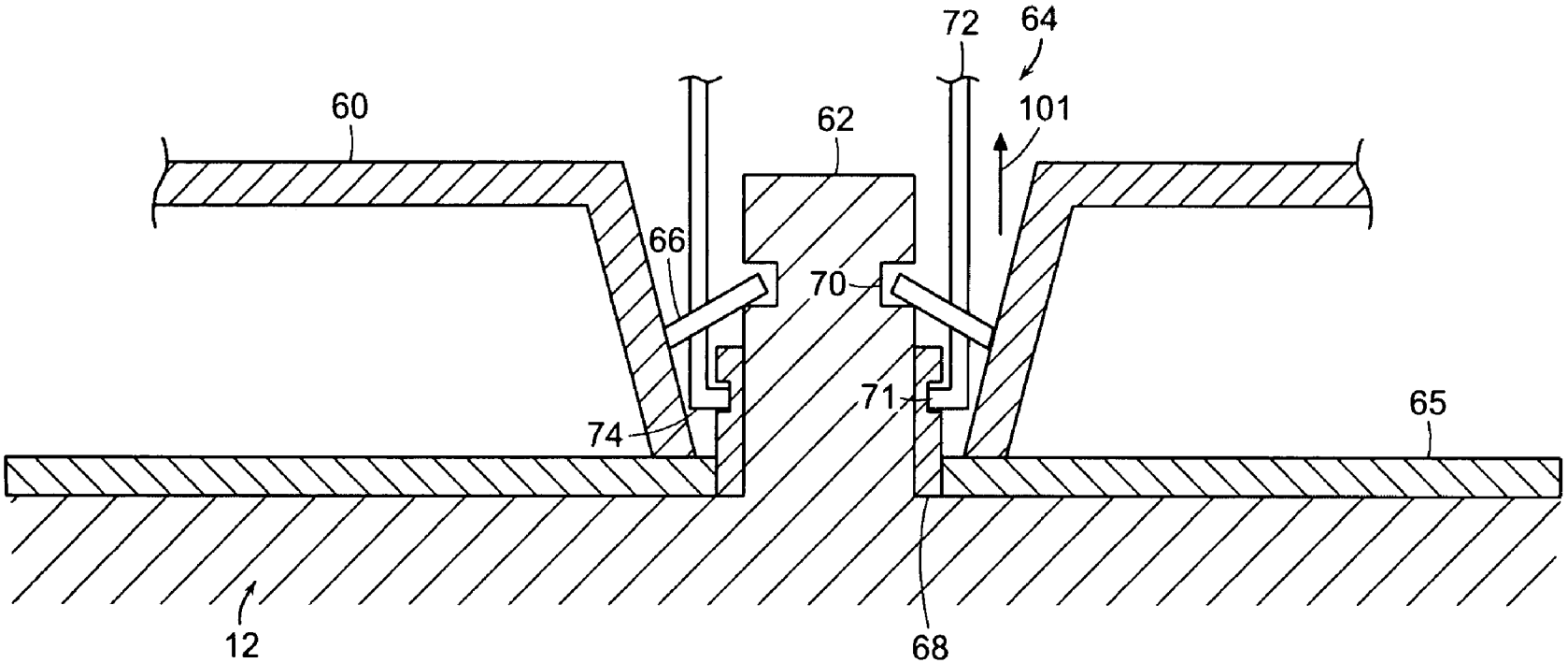
FIG. 25 is an enlarged cross sectional view of the further alternative embodiment of the present invention showing a release tool.

In accordance with an alternative embodiment of the present invention, disassembly of the removable panel 60 and the club head 10 may be accomplished using a release tool 72, as shown in FIG. 25. Release tool 72 may be inserted between the teeth 66 so that hooked portion 74 of the release tool 72 is below the second score line 71 of release collar 68. Once the release tool is inserted between teeth 66, the release tool 72 is then pulled along arrow 101. Hooked portion 74 of release tool 72 will engage with the second score line 71, and release tool 72 is continually pulled until release collar 68 makes contact with teeth 66 and disengages teeth 66 from the first scored line 70 of bore shaft 62.

Figure 26:
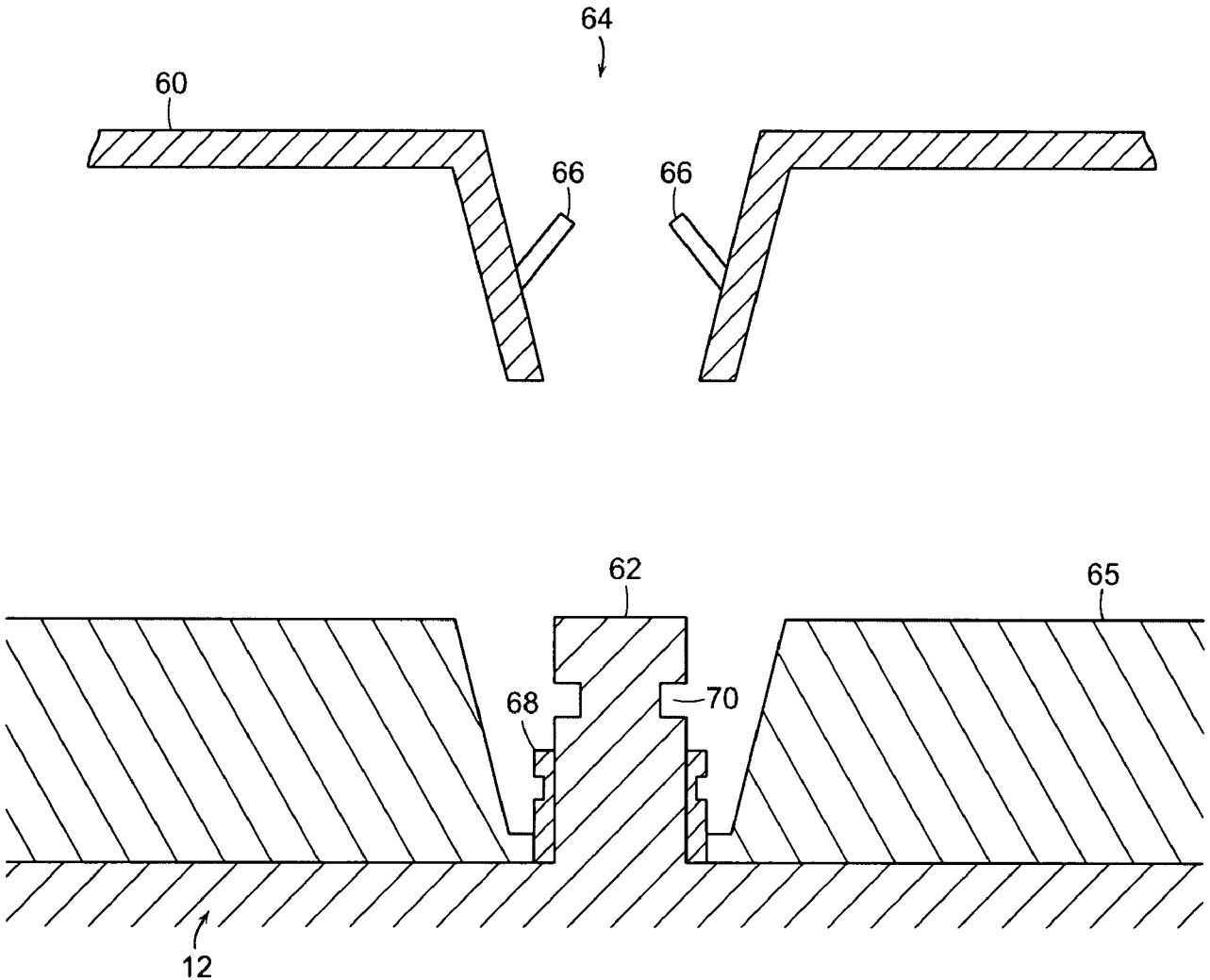
FIG. 26 is an enlarged cross sectional view of an even further alternative embodiment of the present invention with a different vibration dampening layer profile.

FIG. 26 shows a further alternative embodiment of the present invention wherein the vibration dampening layer 65 may have a thicker profile across the entire perimeter of the sole 12 section of the club head 10. In this alternative embodiment the vibration dampening layer may have an increased thickness that is equal to the height of the bore shaft 62 to allow maximum vibration dampening of the entire removable panel 60; however vibration dampening layer 65 may have a reduced thickness ranging from the thickness equally the height of the bore shaft 62 to a bare minimum thickness necessary for vibration dampening all without departing from the scope and content of the present invention. In addition to the thickness profile, vibration dampening layer 65 could have variable thicknesses across the cross-sectional profile to adjust for various vibration dampening needs of the club head 10 also without departing from the scope and content of the present invention.

Figure 27:
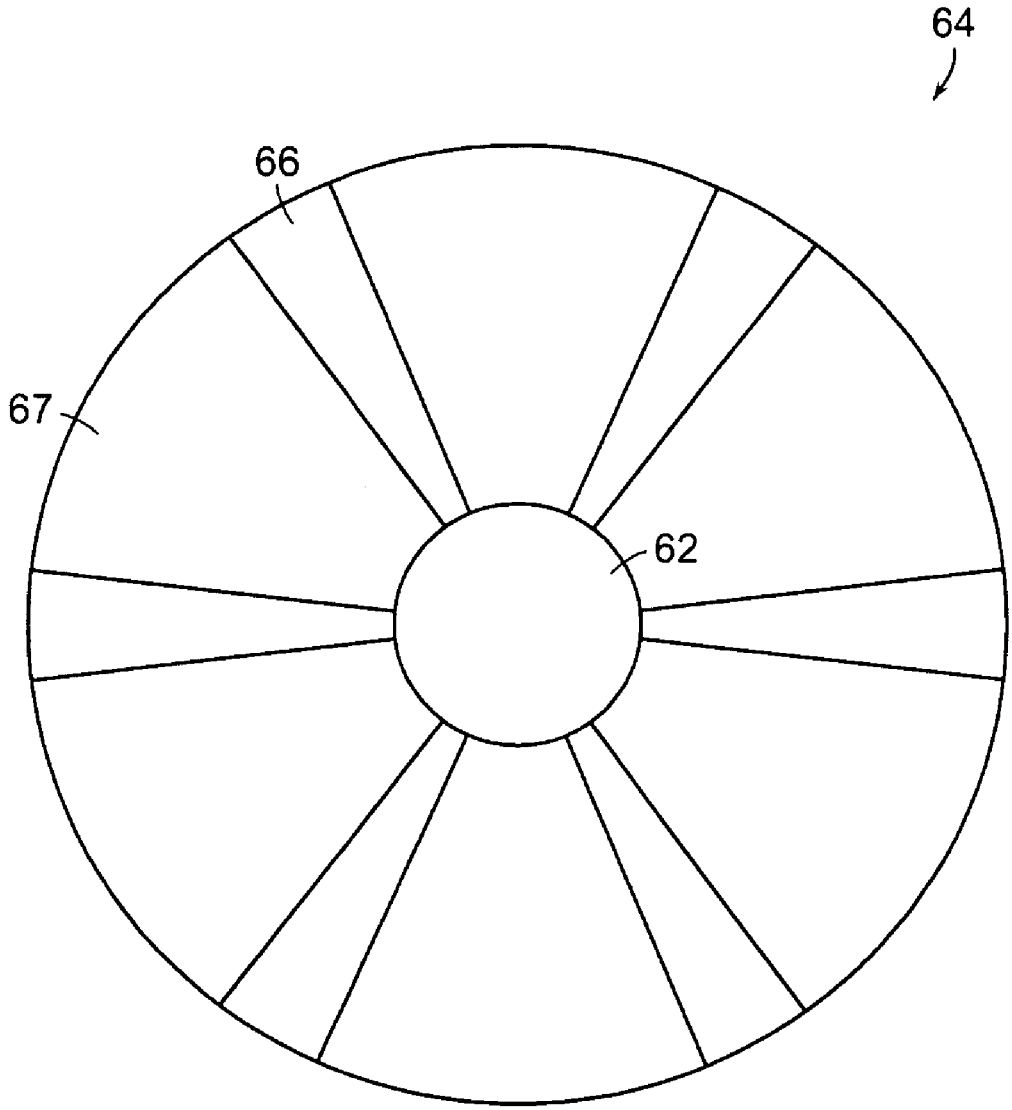
FIG. 27 is an enlarged view of an inverse bore portion in accordance with an alternative embodiment of the present invention.

FIG. 27, as shown in the current exemplary embodiment, shows a top view of a portion of the quick disconnect mechanism 55 showing the inverse bore portion 64, which in turn shows teeth 66 engaged with bore shaft 62 as well as the open areas 67 between the teeth 66.

Figure 28:
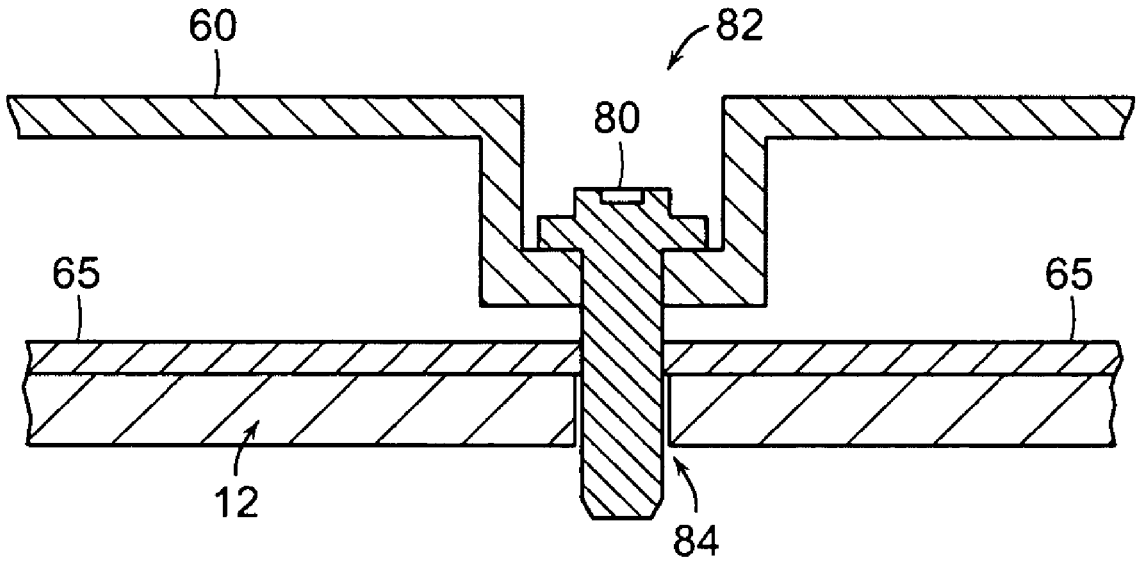
FIG. 28 is a cross sectional view of an even further alternative embodiment of the present invention showing a different variation of the quick disconnect mechanism.

FIG. 28 shows a screw 80 used to secure the removable panel 60 from the sole 12 of the club head 10 as an alternative embodiment of the quick disconnect mechanism 55 in accordance with the present invention. Removable panel 60, as shown in the current exemplary embodiment may generally contain screw wells 82 allowing the screws to sit within the internal profile of club head 10; however, removable panel 60 could contain screws that protrude out from the sole 12 of the club head 10 without any screw wells 82 in accordance with the scope of the present invention. Additionally, the perimeter of the sole 12 of club head 10 may also have threaded receptacles 84 strategically located at positions that correspond with the screw wells 82 to allow the screw 80 to attach the removable panel 60 to club head 10; however, club head 10 may have more threaded receptacles 84 than the number of screw wells 82, or less threaded receptacles 84 than the number of screw wells 82 also without departing from the scope and content of the present invention.

It should be noted that although FIG. 28 shows a screw 80 being inserted externally into the club head 10, the current invention may also utilize a screw that is protruding out from the sole 12 of the head 10 without departing from the scope of the present invention. Under such an alternative embodiment, the current removable panel 60 would have a screw well 82 capable of receiving a nut (not shown) that attaches to the inverted screw. This attachment allows the removable panel 60 to be attached to the club head 10 also without departing from the scope and content of the present invention.

Figure 29:
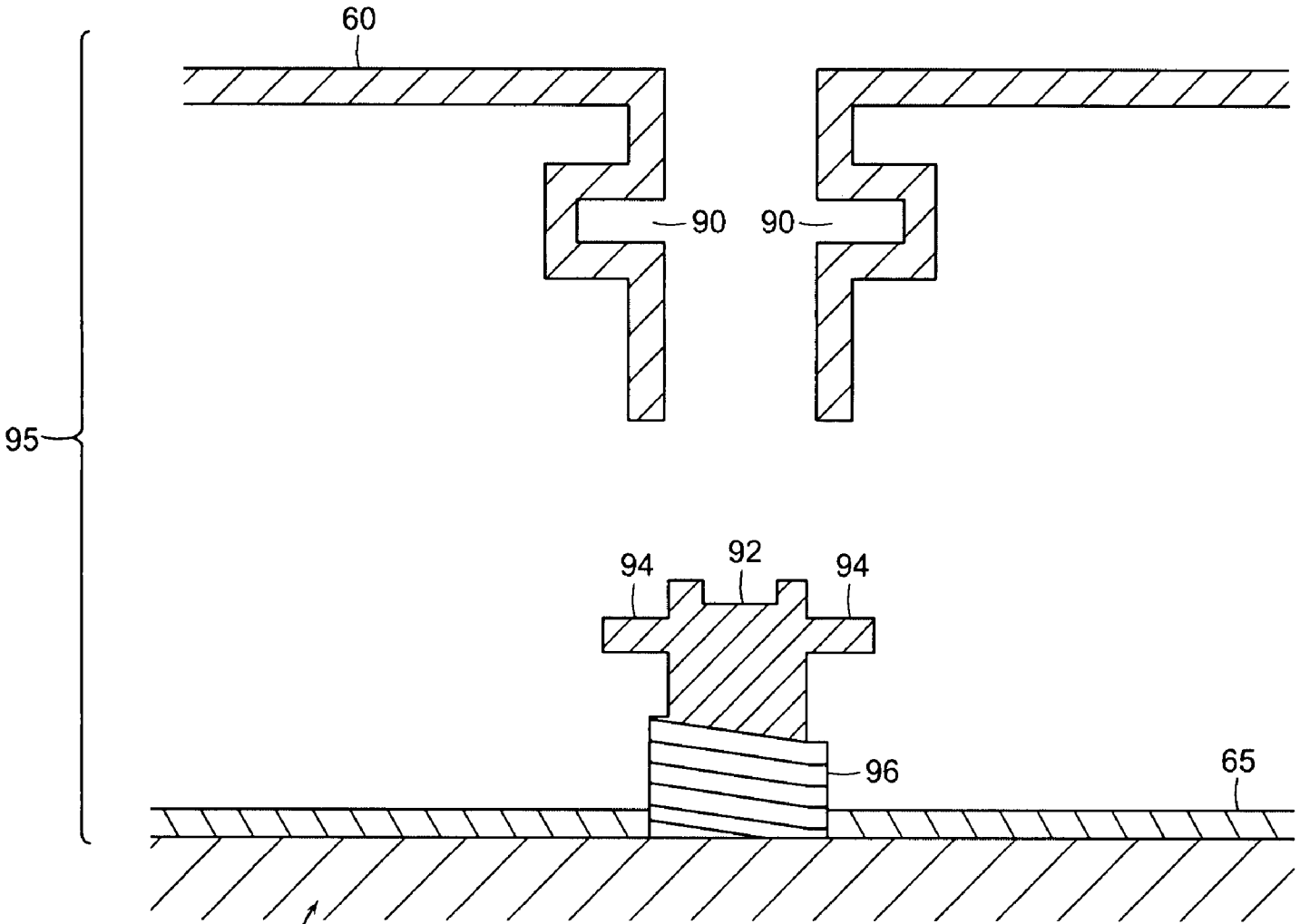
FIG. 29 is a cross sectional view of an even further alternative embodiment of the present invention showing an even further different variation of the quick disconnect mechanism.
Figure 30:
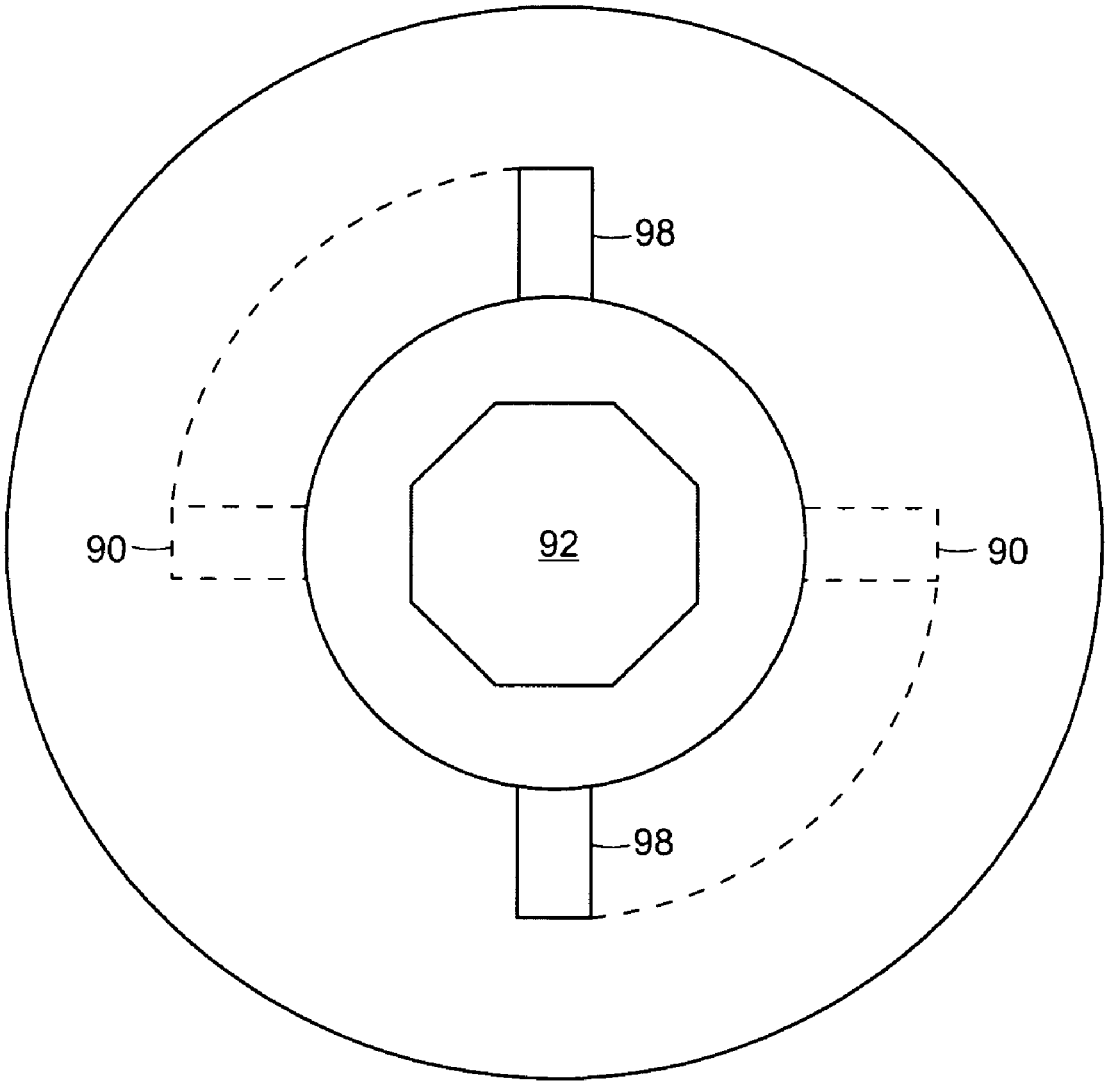
FIG. 30 is a enlarged view of a inverse bore section in accordance with an alternative embodiment of the present invention to match the quick disconnect mechanism shown in FIG. 29.

FIG. 29 and FIG. 30 shows a cross-sectional view and a top view of a further alternative embodiment of the present invention wherein a turn lock mechanism 95 is used to connect the removable panel 60 to the sole 12 of club head 10 as an alternative embodiment to the quick disconnect mechanism 55. In this alternative embodiment, the plurality rotating bore shafts 92 may be connected to a bore shaft spring 96; which in turn may all be connected to the sole 12 of the club head 10 to act as the male component of the rotating lock mechanism 65. Correspondingly, a plurality of locking pin entry slot 98 may connected to the removable panel 60, acting as the female component of the rotating lock mechanism 65 allowing the plurality of rotating bore shafts 92 to engage the removable panel 60.

Rotating bore shafts 92, as shown in the current exemplary embodiment, may contain a plurality of locking teeth 94 extending horizontally from the outer circumference of the rotating bore shaft 92. The plurality of locking teeth 94 are located around the perimeter of the plurality of rotating bore shaft 92, which themselves are located on the sole 12 of club head 10. Plurality of locking teeth 94 may generally be inserted into the plurality of locking teeth entry slots 98. which are located on the removable panel 60 in accordance with the exemplary embodiment of the present invention. Once the plurality of rotating bore shafts 92 passes through the removable panel 60 via the plurality of locking teeth entry slots 98, the plurality of rotating bore shafts 92 may then be securely fastened into their respective locking positions. Fastening the plurality of rotating bore shafts 92 may generally be accomplished by compressing the bore shaft spring 96 and depressing the plurality of rotating bore shafts 92 back into locking teeth entry slot 98 to allow the locking teeth 94 to be aligned with the locking teeth locking pin score line 90. Once the locking teeth 94 are aligned with the locking pin score line 90, the plurality of rotating bore shafts 92 may be individually turned into their secure position within the locking pin score line 90, wherein the bore shaft springs 96 will decompress and secure the removable panel 60 to the sole 12 of club head 10.

In order to disengage the removable panel 60 from the sole 12 of club head 10, a hex shaped release tool (not shown) may be used to depress the bore shaft spring 96, thus allowing the locking teeth 94 to return to its open position. The open position allows the locking teeth 94 to alignment with the locking pin entry slot 98, allowing the removable panel 60 to be disengaged from the sole 12 of club head 10.

Figure 31:
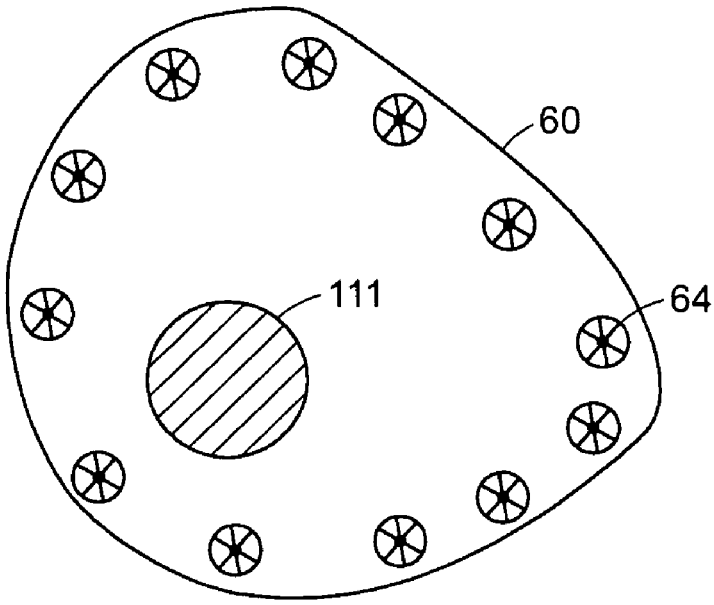
FIG. 31 shows a perspective view alternative embodiment of the present invention wherein the removable panel contains a weight insert.
Figure 32:
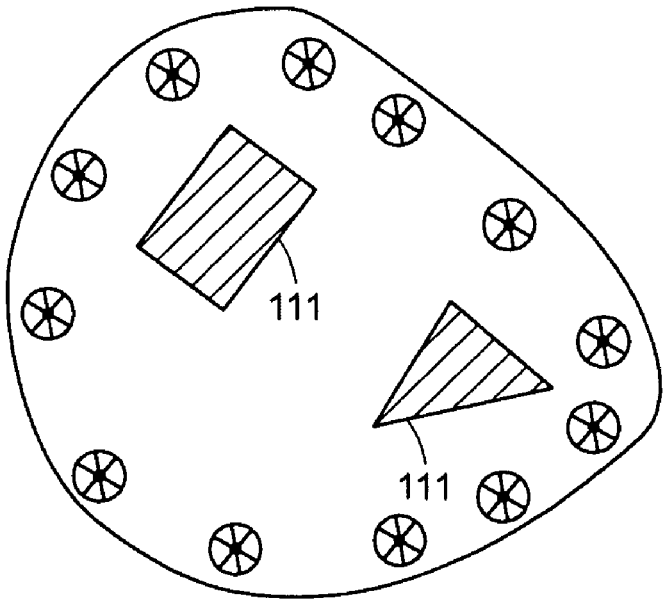
FIG. 32 shows a perspective view of a further alternative embodiment of the present invention wherein the removable panel contains a variation of weight inserts.

FIG. 31 shows a further alternative embodiment of the present invention wherein a weight insert 111 may be strategically placed at a location within the removable panel 60 to increase the weight at a desired location within golf club head 10. This weight insert 111 may utilize the pre-existing removable panel 60's connection mechanism to adjust the center of gravity of club head 10 without departing from the scope of the present invention. FIG. 31 shows the weight insert 111 to be circular in shape and located near the heel of club head 10; however weight insert 111 may be rectangular in shape, triangular in shape, or any other shape capable of adjusting the weight characteristics of golf club head 10 all without departing from the scope and content of the present invention. (See FIG. 32) Moreover, although FIG. 31 only shows one weight insert 111 within the removable panel 60, the removable panel may have two weight inserts 111 as shown in FIG. 32, three weight inserts 111, four weight inserts 111, or any number of weight inserts 111 without departing from the scope of the present invention.

Figure 33:
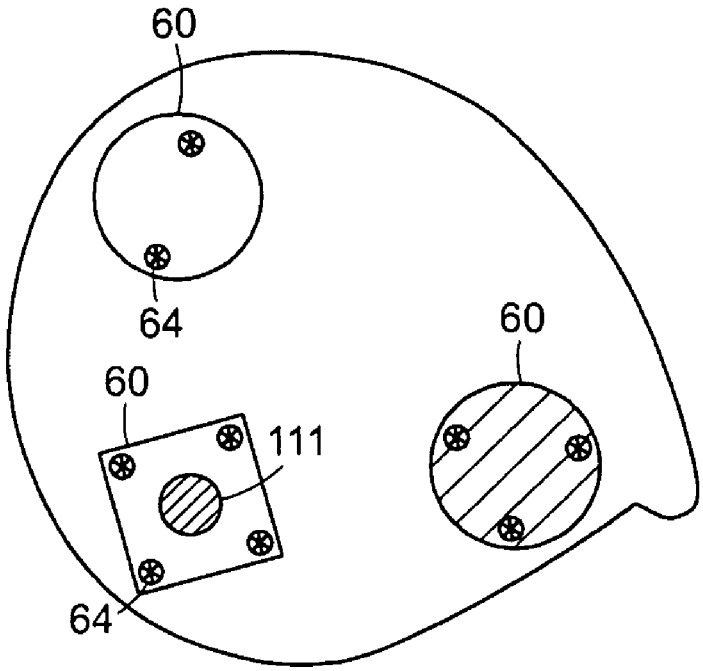
FIG. 33 shows a perspective view of an even further alternative embodiment of the present invention where the removable panel contain a variation of weight inserts.
Figure 34:
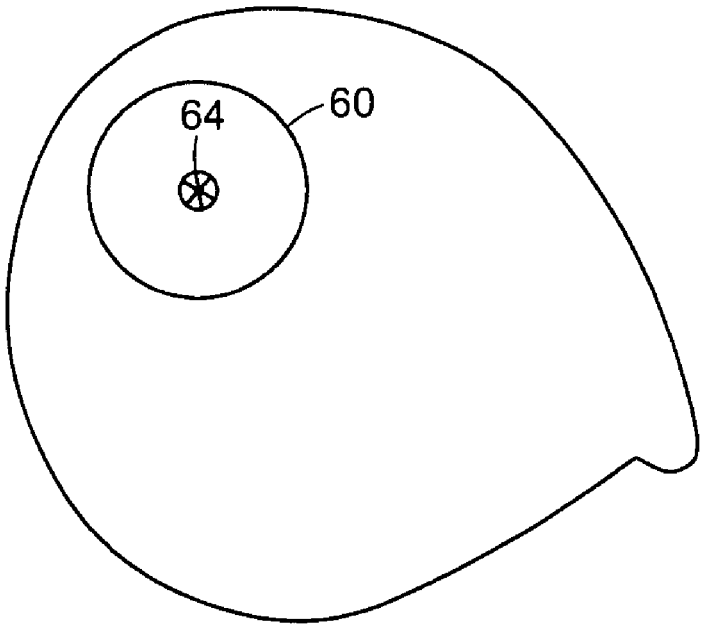
FIG. 34 shows a perspective view of an even further alternative embodiment of the present invention where the removable panel contains a variable connection mechanism.

FIG. 33 and FIG. 44 shows a further alternative embodiment of the present invention wherein the removable panel 60 may be attached to various other locations on club head 10 without the need to cover the entire sole 12 section without departing from the scope and content of the present invention. FIG. 33 and FIG. 44 shows that the removable panel 60 may be in any shape, size, or form, with or without a weight insert 111 all without departing from the scope and content of the present invention.

Figure 35:
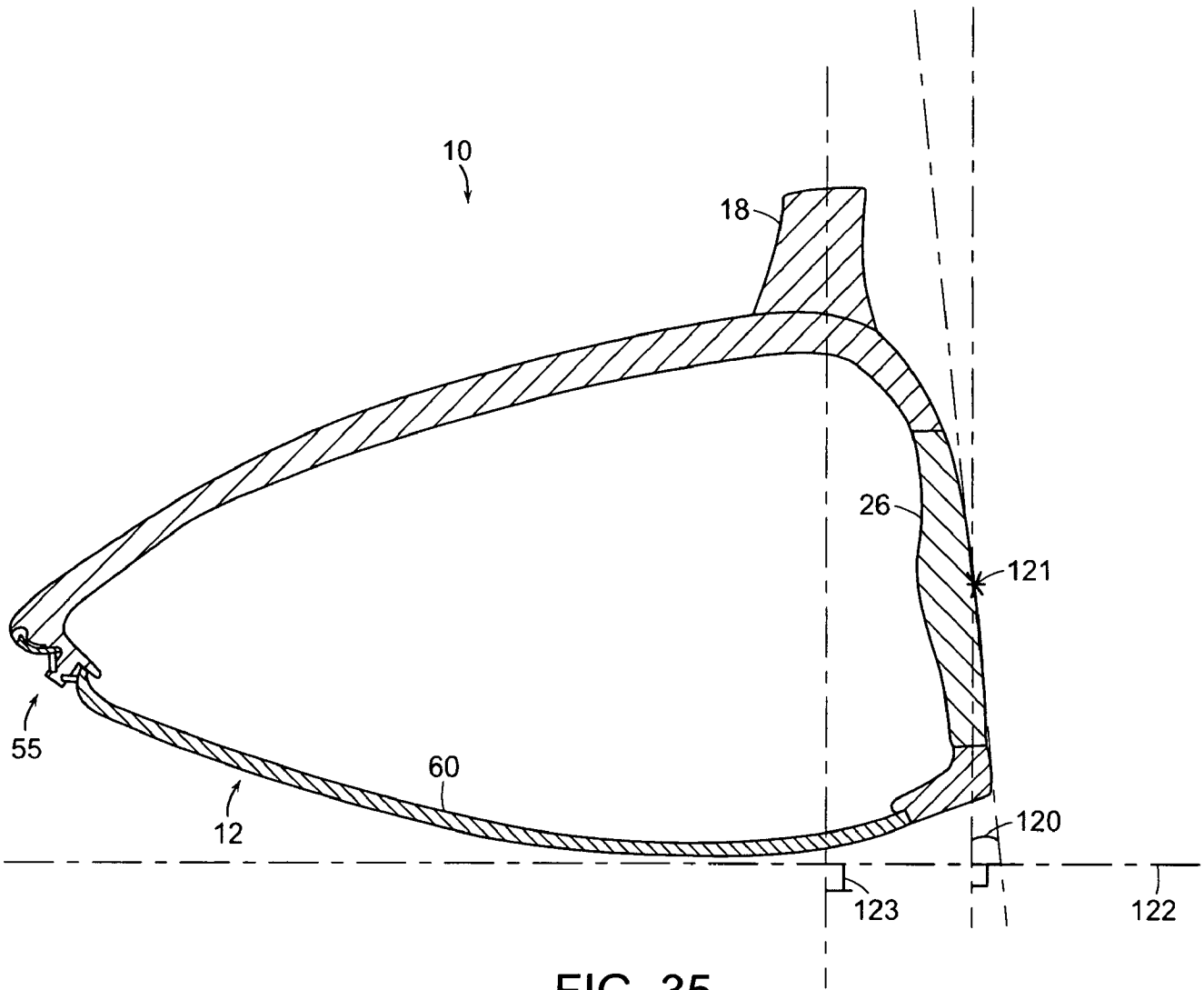
FIG. 35 shows a cross sectional view of an even further alternative embodiment of the present invention showing the removable panel capable of adjusting for loft angle.

FIG. 35 shows a cross-sectional view of golf club head 10 taken along cross-sectional line B-B' (as shown in FIG. 21) in accordance with a further alternative embodiment of the present invention. Golf club head 10, as shown in the current exemplary embodiment, shows an alternative view of the quick disconnect mechanism 55 being located towards an aft portion of golf club head 10. Additionally, FIG. 35 shows a loft angle 120 in accordance with an exemplary embodiment of the present invention that may be adjustable depending on the sole 12 profile of the removable panel 60. Loft angle 120, may generally be an angle that is formed through the face center 121 parallel to the angle of the hitting face 26 and an angle that is perpendicular to the ground 122. Loft angle 120 may generally be defined by the way the club head 10 sits on the ground 122, and may generally be adjust to a position so that the shaft angle 123 is perpendicular to the ground 122. Shaft angle 123, as shown in the current exemplary embodiment, may generally depict the angle that the shaft is inserted into golf club head 10 via a hosel 18, however, shaft angle could be inserted directly into golf club head 10 without a hosel, or any type of mechanism all without departing from the scope and content of the present invention.

Figure 36:
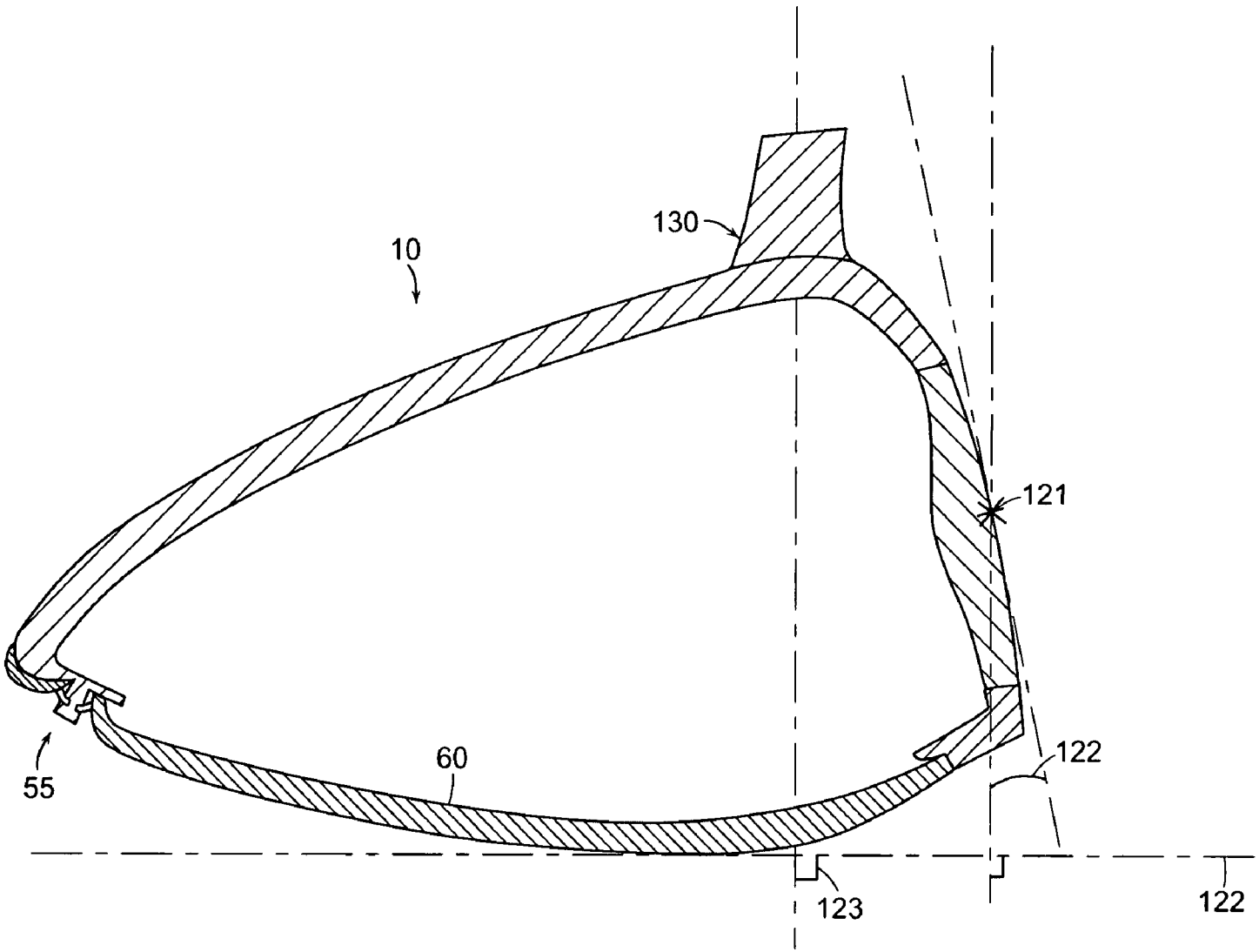
FIG. 36 shows a cross sectional view of an even further alternative embodiment of the present invention showing the removable panel capable of adjusting for loft angle.
Figure 37:
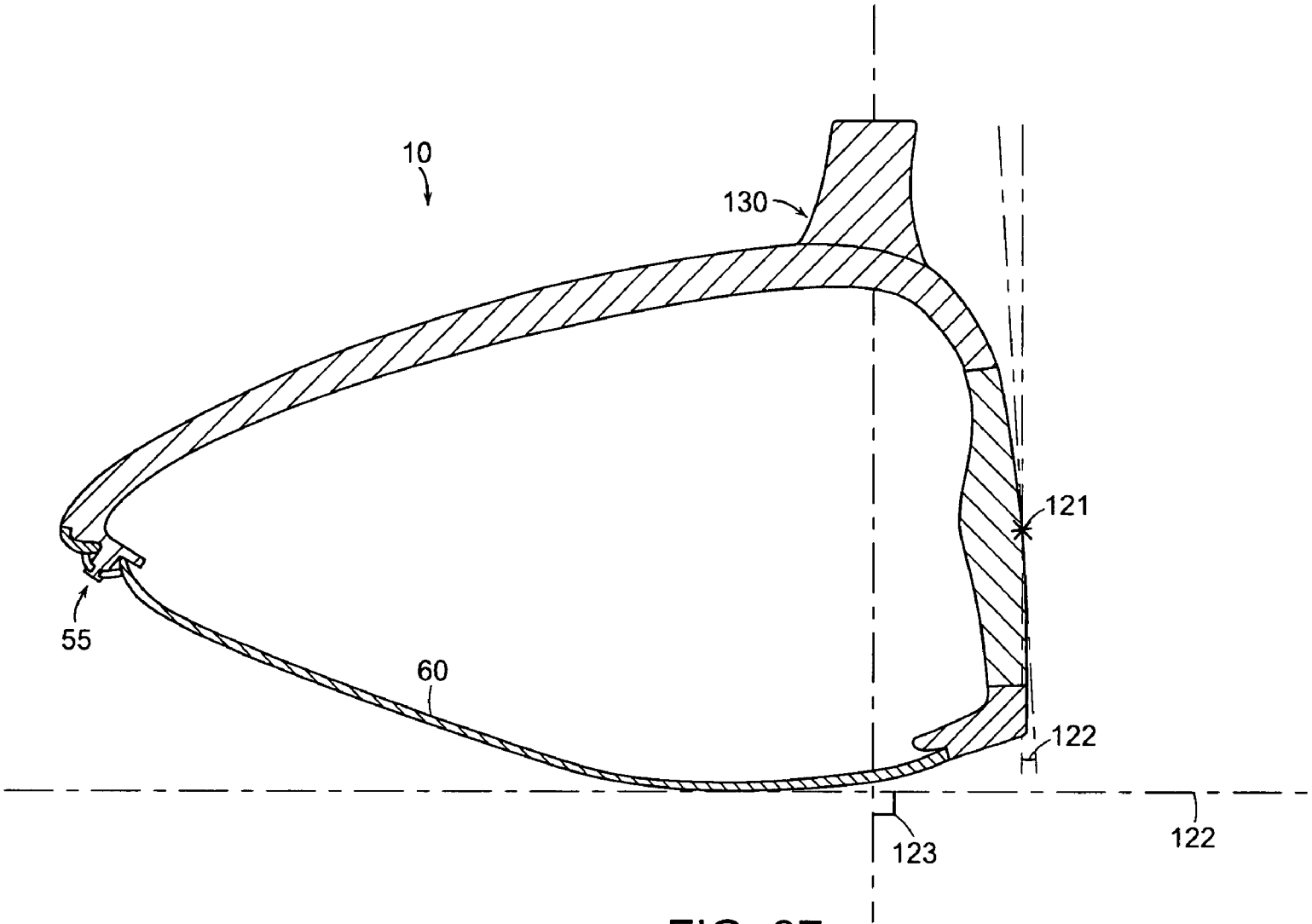
FIG. 37 shows a cross sectional view of an even further alternative embodiment of the present invention showing the removable panel capable of adjusting for loft angle.

FIG. 36 shows a cross-sectional view of golf club head 10 taken along cross-sectional line B-B' (as shown in FIG. 21) in accordance with a further alternative embodiment of the present invention. Golf club head 10, as shown in FIG. 36 may contain a removable panel 60 with a thicker profile, changing the sole profile between golf club head 10 and the ground 122. With a thicker removable panel 60 profile, the angle of golf club head 10 may generally be tilted up higher, creating a higher loft angle 122 as shown in FIG. 36. It may be advantageous to have a sole 12 profile that varies in thickness to create different loft angles 122 in order to allow customization and adjustment of the loft angle 122 without the need to switch a different golf club head 10. Alternatively, golf club head 10 could have a removable panel 60 with a thinner profile, creating a lower loft angle 122 as shown in FIG. 37 also within the scope and content of the present invention.

It should be noted that a mere adjustment in the thickness of the sole 12 profile via the removable panel 60 may cause a shift in the shaft angle 123 from its perpendicular orientation relative to ground 122. In order to compensate for this shift in shaft angle 123, and in an attempt to ensure that the shaft angle 123 maintains its desired position perpendicular to the ground 122 at ninety degrees, a shaft adjustment mechanism 130 (shown in more detail in FIG. 38) may be placed between the hosel 18 and the golf club head 10.

Figure 38:
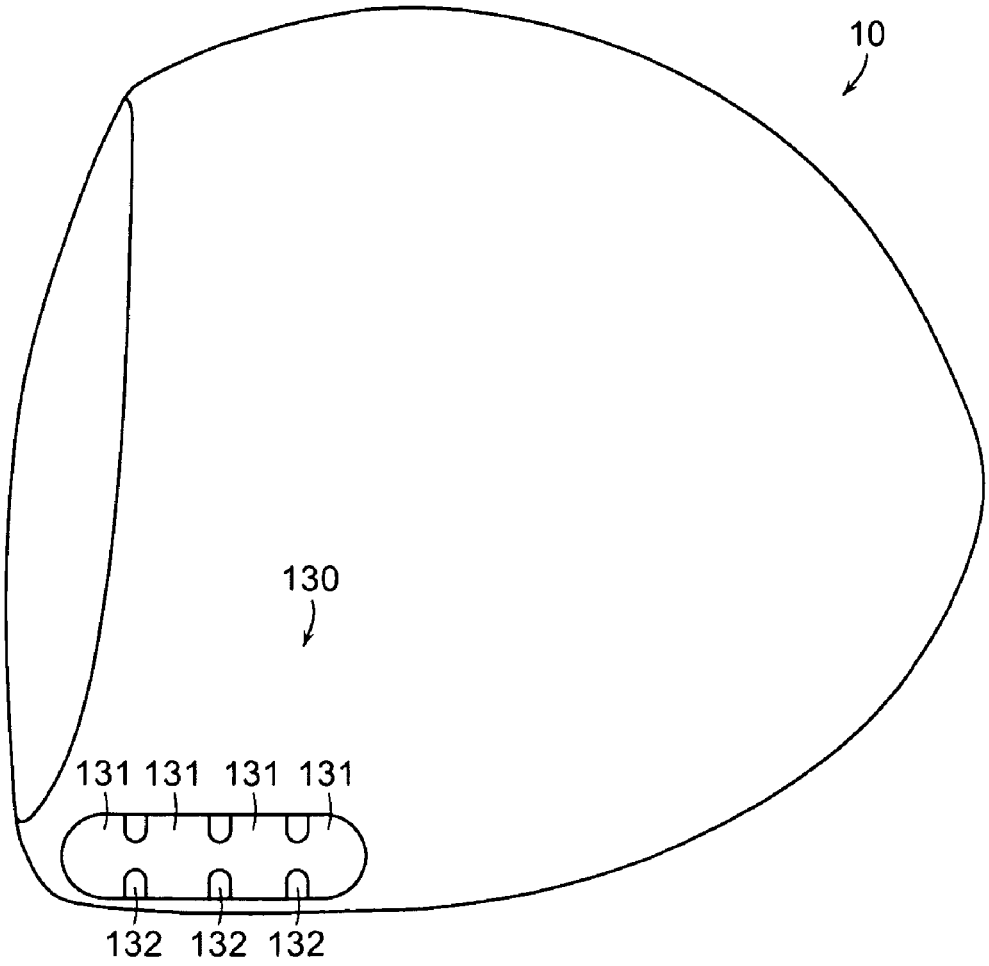
FIG. 38 shows a top view of an even further alternative embodiment of the present invention showing a shaft adjustment mechanism.

FIG. 38 shows a top view of golf club head 10 in accordance with an alternative embodiment of the present invention allowing a better view of the shaft adjustment mechanism 130. Shaft adjustment mechanism 130 may be used to compensate for the change in shaft angle 123 when various thickness profiles are used for removable panel 60 to achieve the desirable loft angle 120. In one exemplary embodiment, shaft adjustment mechanism 130 may contain a plurality of one or more shaft slots 131 separated from each other using a plurality of separators 132 that define a preset location for a shaft to fit within a shaft slot 131. A shaft adjustment mechanism 130, as shown in the current exemplary embodiment, may generally have three or fours shaft slots matching with the various loft angles 122 created by the various removable panels 60; however, any other number of shaft slots 131 may be used to achieve the same goal of having multiple adjustability all without departing from the scope and content of the present invention.

The various shaft slots 131, as shown in the current exemplary embodiment may generally be used to match a predetermined shaft angle 123 that results from the various removable panels 60. Each removable panel 60 may generally be used to achieve a different loft angle 120 matching with a corresponding shaft slot 131 that may be used to bring the shaft angle 123 back to being perpendicular to the ground 122. It should be noted that although FIG. 38 shows one exemplary embodiment of the shaft adjustment mechanism 130, various other shaft adjustment mechanisms may also be used that may involve a ball and socket joint, a circular joint, a toothed joint, or any mechanism capable of adjusting for the shift in shaft angle 123 resulting from the loft angle 120 change all without departing from the scope and content of the present invention. Other alternative shaft adjustment mechanisms 130 may be disclosed by U.S. patent application Ser. No. 12/336,748 and the disclosure of which is incorporated by reference in its entirety.

Having a uniform golf club head 10 with variable removable panels 60 and a shaft adjustment mechanism may allow a single golf club head 10 to be designed, manufactured, and used while having a variety of loft angles 120 available for the consuming needs. This uniformly produced golf club head 10 may generally be beneficial in saving production costs, as only one golf club head 10 needs to be manufactured in order to achieve an entire line of golf club heads 10 that have varying loft angles 120. Additionally, various removable panels 60 may also allow the consuming public to adjust various lofts on the fly to adjust for various playing conditions.

Figure 39:
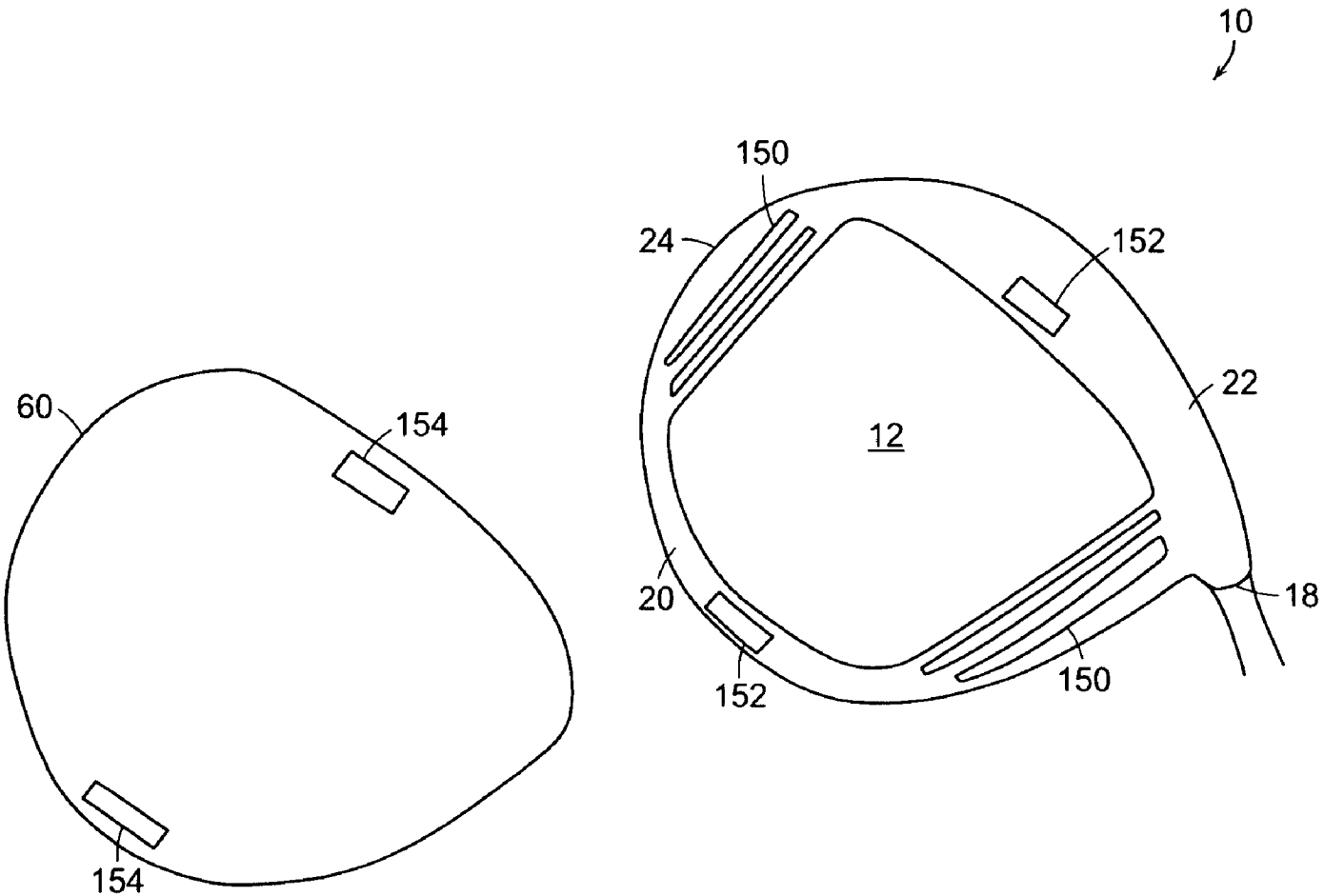
FIG. 39 shows an exploded view of an even further alternative embodiment of the present invention wherein the removable panel is slidably attached to the golf club head.

FIG. 39 shows an exploded view of a golf club head 10 in accordance with an even further alternative embodiment of the present invention wherein the removable panel 60 may be slidably attached to the sole 12 of the golf club head 10 via a plurality of slidable guide rails 150. Slidable guide rails 150, as shown in the current exemplary embodiment, may generally rest on the toe side and heel side of the sole 12, allowing the removable panel 60 to slide onto golf club head 10. Plurality of slidable guide rails 150 on the golf club head 10 may generally mate with a plurality of guide rail slots (shown in more detail in FIG. 42) on the removable panel 60 to guide the assembly of the removable panel 10. Golf club head 10 in accordance with this further alternative embodiment of the present invention may further contain a plurality of spring loaded snaps 152 located on the sole 12 of the golf club head 10 to ensure that the removable panel 60 does not slide out from the golf club head 10.

Figure 40:
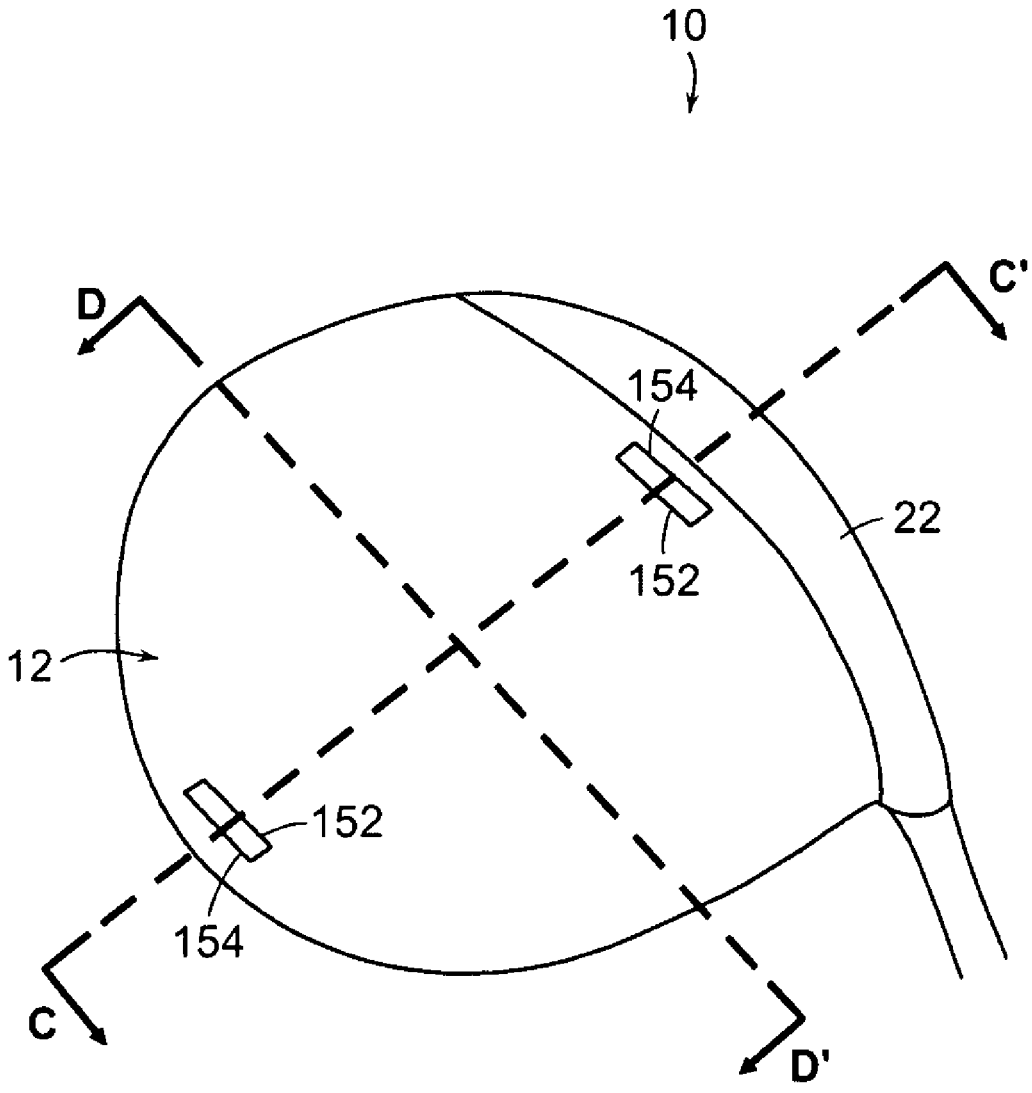
FIG. 40 shows a perspective view of the further alternative embodiment of the present invention wherein the removable panel is slidably attached to the golf club head.

Turning now to FIG. 40, which shows a perspective view of the present invention wherein the removable panel 60 is attached to the sole 12 of the club head 10 utilizing the plurality of slidable guide rails 150 as an alternate attachment mechanism. (Shown earlier in FIG. 39). As it can be seen from FIG. 40, in an assembled mode, the plurality of spring loaded snaps 152 mate with the plurality of snap receivers 154 to secure the removable panel to the sole 12 of the golf club head 10. FIG. 40 also shows potential cross-sectional lines C-C' and D-D', which will more clearly show the slidable connection mechanism in accordance with the even further alternative embodiment of the present invention.

Figure 41:
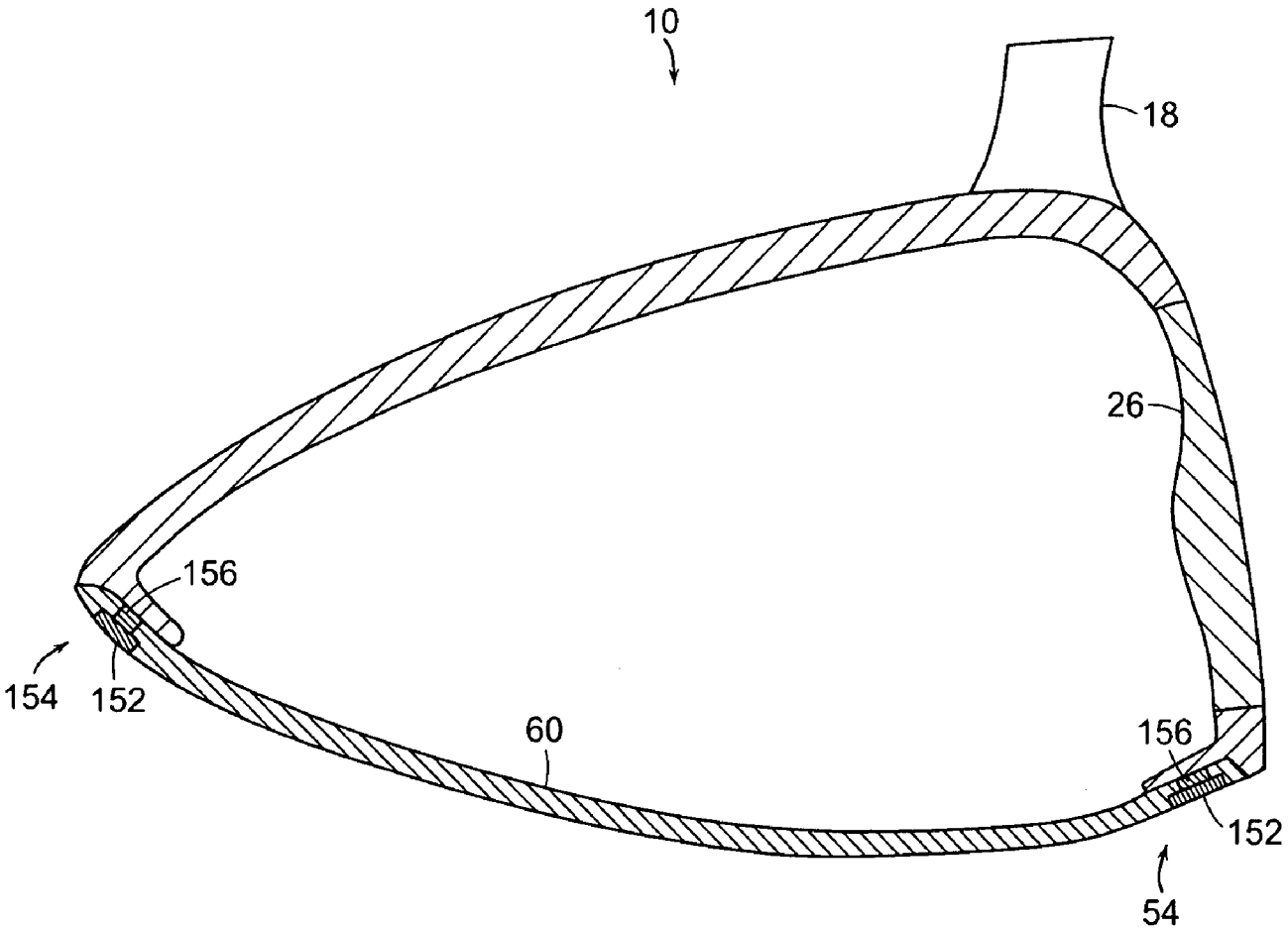
FIG. 41 shows a cross-sectional view of the further alternative embodiment of the present invention wherein the removable panel is slidably attached to the golf club head.

FIG. 41 shows a cross-sectional view of golf club head 10 in accordance with the even further alternative embodiment of the present invention taken along cross-sectional line C-C' as shown in FIG. 40. FIG. 41 shows the weight panel 60 being slidably attached to the sole 12 of the golf club head 10, while utilizing the plurality of spring loaded snaps 152 to lock the removable panel into the plurality of snap receivers 154. Spring loaded snaps 152, as shown in the current exemplary embodiment, may contain a plurality of snap springs 156 attached to the rear portion of the mechanism to help secure the spring loaded snaps 152 into the proper position. Although the current exemplary embodiment may show two spring loaded snaps 152, the current invention may contain only one spring loaded snap 152, three spring loaded snaps 152, four spring loaded snaps 152, or any number of spring loaded snaps 152 so long as it serves to lock in the removable panel 60 to the golf club head 10 all without departing from the scope and content of the present invention.

In order to disengage the plurality of spring loaded snaps 152 from the plurality of snap receivers 154, pressure may be applied to the plurality of spring loaded snaps 152, allowing the plurality of snap springs 156 to compress. Once the plurality of snap springs 156 compresses, the plurality of spring loaded snaps will disengage the plurality of snap receivers, allowing the removable panel 60 to slide away from golf club head 10.

Figure 42:
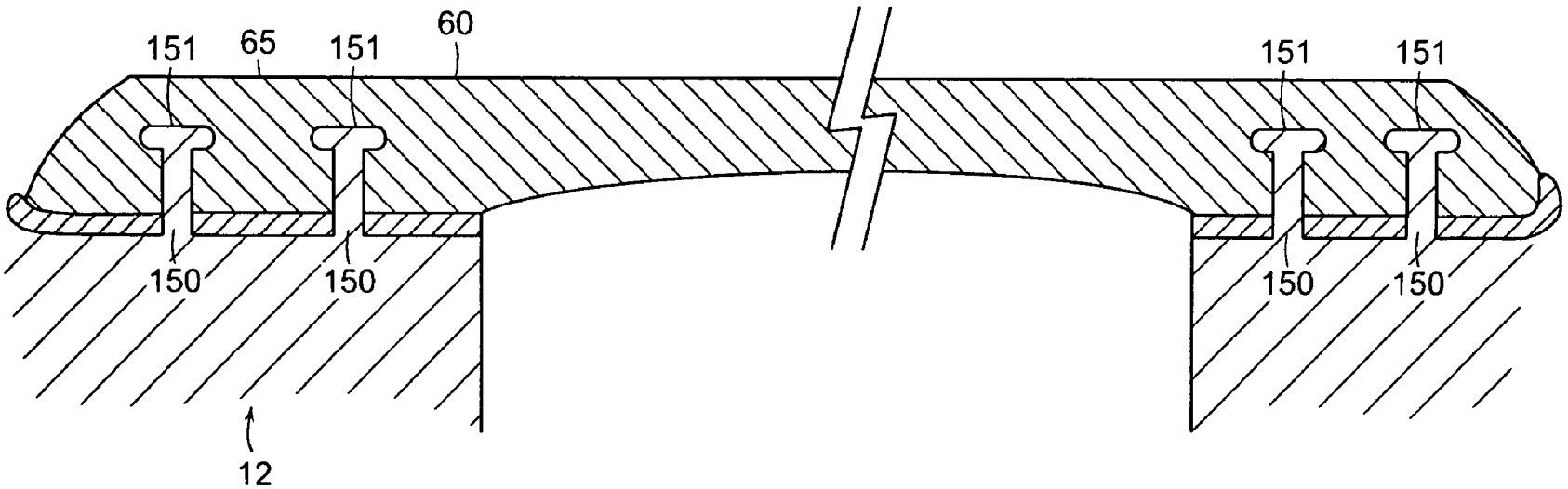
FIG. 42 shows a cross-sectional view of the further alternative embodiment of the present invention wherein the removable panel is slidably attached to the golf club head.

FIG. 42 shows a cross-sectional view of golf club head 10 in accordance with the further exemplary embodiment of the present invention taken along cross-sectional line D-D' as shown in FIG. 40. FIG. 42 shows a plurality of slidable guide rails 150 running along the toe portion and the heel portion of the sole 12 of the golf club head 10. This plurality of slidable guide rails 150 may generally mate with a plurality of guide rail slots 151 that is located to on the removable panel 60 to properly engage the removable panel 60 with the golf club head 10. FIG. 42 may also show the plurality of slidable guide rails 150 and the plurality of guide rail slots 151 both being of a hammerhead shape to further ensure a secure connection between the removable panel 60 and the golf club head 10. However, it should be noted that numerous other geometric shapes similar to that of a hammerhead may be used to provide the connection between the removable panel 60 and golf club head 10 all without departing from the scope and content of the present invention.

Golf club head 10, as shown in the current exemplary embodiment, may generally have the plurality of slidable guide rails located on the sole 12 of golf club head 10, while keeping the guide rail slots 151 on the removable panel 60. However, it should be noted that the slidable guide rails 150 may be located on the removable panel 60 and the guide rail slots 151 may be located on the sole 12 of golf club head 10 without departing from the scope and content of the present invention. Slidable guide rails 150, as shown in the current exemplary embodiment, may generally be rectangular protrusions on the sole 12 of the golf club head 10; however, slidable guide rails 150 may be triangular protrusions, circular protrusions, or any other form of protrusion that is capable of allowing the removable panel 60 to assemble onto golf club head 10 all without departing from the scope and content of the present invention.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment(s) and steps or elements from methods in accordance with the present invention can be executed or performed in any suitable order. Therefore, it will be understood that the appended claims are intended to cover all such modifications and embodiments, which would come within the spirit and scope of the present invention.

What is claimed is:

1. A golf club head comprising:

a hosel, a face, a crown, a skirt, and a sole;

wherein said sole further comprises a removable panel releasably attached to said sole, wherein said removable panel is connected to said sole utilizing a quick disconnect mechanism, wherein said hosel further comprises a shaft adjustment mechanism to adjust a shaft angle of said golf club head, wherein said quick disconnect mechanism is a non-threaded attachment mechanism, and wherein said shaft adjustment mechanism further comprises:

a plurality of shaft slots, each allowing a shaft to be connected to said golf club head at a different shaft angle; and a plurality of separators interposed between said plurality of shaft slots to secure said shaft to said golf club head.

2. The golf club head of claim 1, wherein said quick disconnect mechanism further comprises:

a bore shaft protruding from said sole of said golf club head;

a plurality of teeth providing a male component between said sole and said removable panel;

a plurality of score lines providing a female component with said plurality of teeth between said sole and said removable panel;

wherein said plurality of teeth and said plurality of score lines engage one another to resist withdrawal of said removable panel from said golf club head.

3. The golf club head of claim 2, further comprises a vibration dampening layer interposed between said removable panel and said sole of said golf club head.

4. The golf club head of claim 3, wherein said plurality of teeth is locate on said removable panel and said plurality of score lines is located on said bore shaft.

5. The golf club head of claim 3, wherein said plurality of teeth is located on said bore shaft and said plurality of score lines is located on said removable panel.

6. The golf club head of claim 3, wherein said quick disconnect mechanism further comprises a release tool and wherein said release tool is adapted to disengage said plurality of teeth from said plurality of score lines.

7. An interchangeable golf club head system comprising:

a golf club head containing a first portion of a quick disconnect mechanism;

a plurality of removable panels each containing a second portion of said quick disconnect mechanism; and a shaft adjustment mechanism connected to a hosel of said golf club head;

wherein each of said plurality of removable panels contain a different sole profile, each creating a different loft angle relative to a horizontal ground in the address position; and wherein a first removable panel containing a first sole profile is selected from said plurality of removable panels and connected to said golf club head utilizing said quick disconnect mechanism creating a first loft angle of said golf club head; and wherein said shaft adjustment mechanism maintains a shaft angle of said golf club head in a desired position relative to a horizontal ground in the address position irrespective of said first loft angle created by said first sole profile of said first removable panel, and wherein said shaft adjustment mechanism further comprises:

a plurality of shaft slots, each allowing a shaft to be connected to said golf club head at a different shaft angle; and a plurality of separators interposed between said plurality of shaft slots to secure said shaft to said golf club head.

8. The interchangeable golf club head system of claim 7, wherein said desired position of said shaft angle is 90 degrees relative to a ground level.

9. The interchangeable golf club head system of claim 7, wherein said shaft adjustment mechanism maintains said shaft angle of said golf club head at said desired position when said first removable panel is replaced with a second removable panel containing a second sole profile creating a second loft angle.

10. The interchangeable golf club head system of claim 7, wherein said quick disconnect mechanism is a non-threaded attachment mechanism.

11. The interchangeable golf club head system of claim 10, wherein said quick disconnect mechanism further comprises:

a bore shaft protruding from said sole of said golf club head;

a plurality of teeth providing a male component between said sole and said removable panel; and a score line providing a female component between said sole and said removable panel;

wherein said plurality of teeth and said score line engage one another to resist withdrawal of said removable panel from said golf club head.

12. The interchangeable golf club head system of claim 11, further comprises a vibration dampening layer interposed between said removable panel and said golf club head.

13. The interchangeable golf club head system of claim 12, wherein said plurality of teeth is located on said removable panel and said score line is located on said bore shaft.

14. The interchangeable golf club head system of claim 12, wherein said plurality of teeth is located on said bore shaft and said score line is located on said removable panel.

15. A golf club head comprising:

a hosel, a face, a crown, a skirt, and a sole;

wherein said sole further comprises a removable panel releasably attached to said sole, wherein said removable panel contains a sole profile that creates a loft angle of said golf club head, wherein said hosel further comprises a shaft adjustment mechanism to maintain a shaft angle at a position perpendicular to a ground plane irrespective of said loft angle, wherein said removable panel is releasably attached to said sole utilizing a non-threaded attachment mechanism, and wherein said shaft adjustment mechanism further comprises:

a plurality of shaft slots, each allowing a shaft to be connected to the golf club head at a different shaft angle; and a plurality of separators interposed between said plurality of shaft slots to secure said shaft to said golf club head.

16. The golf club head of claim 15, further comprises a vibration dampening layer interposed between said removable panel and said sole of said golf club head.

* * * * *